US007857696B2

(12) United States Patent
Tarantino

(10) Patent No.: US 7,857,696 B2
(45) Date of Patent: Dec. 28, 2010

(54) SYSTEM AND METHOD OF PAUSING AND RESTARTING WAGERING GAMES

(75) Inventor: Elia Rocco Tarantino, Las Vegas, NV (US)

(73) Assignee: IGT, Reno, NV (US)

( * ) Notice: Subject to any disclaimer, the term of this patent is extended or adjusted under 35 U.S.C. 154(b) by 35 days.

(21) Appl. No.: 11/999,694

(22) Filed: Dec. 5, 2007

(65) Prior Publication Data

US 2008/0090650 A1 Apr. 17, 2008

Related U.S. Application Data

(63) Continuation of application No. 11/347,769, filed on Feb. 3, 2006, now abandoned, which is a continuation of application No. 09/838,949, filed on Apr. 19, 2001, now abandoned, which is a continuation-in-part of application No. 09/684,759, filed on Oct. 6, 2000, now abandoned, which is a continuation-in-part of application No. 09/553,915, filed on Apr. 20, 2000, now Pat. No. 6,605,001, which is a continuation-in-part of application No. 09/439,934, filed on Nov. 12, 1999, now Pat. No. 6,656,047, which is a continuation-in-part of application No. 09/298,604, filed on Apr. 23, 1999, now abandoned.

(51) Int. Cl.
*A63F 9/24* (2006.01)

(52) U.S. Cl. ..... 463/24; 463/29

(58) Field of Classification Search ..... 463/24, 463/25, 29, 43, 47, 1, 16; 273/138.1, 138.2, 273/148 R See application file for complete search history.

(56) References Cited

U.S. PATENT DOCUMENTS

| | | | |
|---|---|---|---|
| 2,205,471 | A | 6/1940 | Fagerholm |
| 2,474,573 | A | 6/1949 | Cohen |
| 2,743,108 | A | 4/1956 | Sanders |
| 2,812,182 | A | 11/1957 | Fiorino |
| 2,842,368 | A | 7/1958 | Williams |

(Continued)

FOREIGN PATENT DOCUMENTS

| | | |
|---|---|---|
| DE | 27 24 153 | 8/1978 |

(Continued)

OTHER PUBLICATIONS

Author Unknown, "Autotote Corporation Profile," Autotote, Sep. 1993, pp. 1-5.

(Continued)

*Primary Examiner*—Dmitry Suhol
*Assistant Examiner*—Robert Mosser
(74) *Attorney, Agent, or Firm*—K&L Gates LLP

(57) ABSTRACT

A system and method permit pausing/saving a game and restarting/restoring a game. In one embodiment, a player may pause a wagering game and then restart or restore that game at a later time and at the same or a different gaming machine. Game state information may be stored on a machine readable medium and then later read from that medium. Alternatively, game state information may be stored remotely from a gaming machine, such as at a remote server. The remotely stored information may be identified by information associated with a machine readable medium issued to the player or other information provided by the player.

15 Claims, 13 Drawing Sheets

U.S. PATENT DOCUMENTS

| | | | | |
|---|---|---|---|---|
| 3,505,646 | A | | 4/1970 | Affel, Jr. et al. |
| 3,549,150 | A | | 12/1970 | Weeks |
| 3,655,199 | A | | 4/1972 | Ohki |
| D228,142 | S | | 8/1973 | Mannina |
| 3,843,133 | A | | 10/1974 | Brown |
| 4,015,850 | A | | 4/1977 | Russell |
| 4,033,588 | A | | 7/1977 | Watts |
| 4,066,264 | A | | 1/1978 | Rowman |
| 4,093,215 | A | | 6/1978 | Ballard |
| 4,126,851 | A | | 11/1978 | Okor |
| 4,149,727 | A | | 4/1979 | Penney |
| 4,193,598 | A | | 3/1980 | Freese |
| 4,218,063 | A | | 8/1980 | Cooper et al. |
| 4,247,106 | A | | 1/1981 | Jeffers et al. |
| 4,322,612 | A | | 3/1982 | Lange |
| 4,335,809 | A | | 6/1982 | Wain |
| 4,339,798 | A | | 7/1982 | Hedges et al. |
| 4,359,227 | A | | 11/1982 | Porciello |
| 4,372,558 | A | | 2/1983 | Shimamoto et al. |
| 4,389,048 | A | | 6/1983 | Burgess |
| 4,443,012 | A | | 4/1984 | Makovic et al. |
| 4,467,424 | A | | 8/1984 | Hedges et al. |
| 4,494,197 | A | | 1/1985 | Troy et al. |
| 4,506,890 | A | | 3/1985 | Murry |
| 4,517,656 | A | | 5/1985 | Solimeno et al. |
| 4,564,923 | A | | 1/1986 | Nakano |
| 4,570,930 | A | | 2/1986 | Matheson |
| 4,572,509 | A | | 2/1986 | Sitrick |
| 4,573,681 | A | | 3/1986 | Okada |
| 4,614,342 | A | | 9/1986 | Takashima |
| 4,636,174 | A | | 1/1987 | Andersen et al. |
| 4,648,602 | A | | 3/1987 | Maroney |
| 4,657,256 | A | | 4/1987 | Okada |
| 4,695,053 | A | | 9/1987 | Vazquez, Jr. et al. |
| 4,720,108 | A | | 1/1988 | Gramera |
| 4,752,068 | A | * | 6/1988 | Endo ..... 463/15 |
| 4,760,527 | A | | 7/1988 | Sidley |
| 4,834,386 | A | | 5/1989 | Rosenthal et al. |
| 4,836,553 | A | | 6/1989 | Suttle et al. |
| 4,837,728 | A | | 6/1989 | Barrie et al. |
| 4,861,041 | A | | 8/1989 | Jones et al. |
| 4,961,581 | A | | 10/1990 | Barnes et al. |
| 4,986,546 | A | | 1/1991 | Cerulla |
| 4,995,615 | A | | 2/1991 | Cheng |
| 5,031,914 | A | | 7/1991 | Rosenthal |
| 5,043,889 | A | | 8/1991 | Lucey |
| 5,102,134 | A | | 4/1992 | Smyth |
| 5,112,050 | A | | 5/1992 | Koza et al. |
| 5,129,652 | A | | 7/1992 | Wilkinson |
| 5,193,815 | A | | 3/1993 | Pollard |
| 5,221,083 | A | | 6/1993 | Dote |
| 5,290,033 | A | | 3/1994 | Bittner et al. |
| 5,301,952 | A | | 4/1994 | Fitzgerald |
| 5,324,041 | A | | 6/1994 | Boylan et al. |
| 5,356,140 | A | | 10/1994 | Dabrowski et al. |
| 5,374,060 | A | | 12/1994 | Goldberg |
| 5,380,008 | A | | 1/1995 | Mathis et al. |
| 5,393,067 | A | | 2/1995 | Paulsen et al. |
| 5,401,024 | A | | 3/1995 | Simunek |
| 5,411,260 | A | | 5/1995 | Smith |
| 5,417,424 | A | | 5/1995 | Snowden et al. |
| 5,462,277 | A | | 10/1995 | Takemoto |
| 5,472,195 | A | | 12/1995 | Takemoto et al. |
| 5,482,289 | A | | 1/1996 | Weingardt |
| 5,489,096 | A | | 2/1996 | Aron |
| 5,560,610 | A | | 10/1996 | Behm et al. |
| 5,564,977 | A | | 10/1996 | Algie |
| 5,613,679 | A | | 3/1997 | Casa et al. |
| 5,624,119 | A | | 4/1997 | Leake |
| 5,649,704 | A | | 7/1997 | Dobbin |
| 5,669,817 | A | | 9/1997 | Tarantino |
| 5,697,843 | A | | 12/1997 | Manship et al. |
| 5,727,786 | A | | 3/1998 | Weingardt |
| 5,732,948 | A | | 3/1998 | Yoseloff |
| 5,768,382 | A | * | 6/1998 | Schneier et al. ..... 380/251 |
| 5,772,509 | A | | 6/1998 | Weiss |
| 5,772,510 | A | | 6/1998 | Roberts |
| 5,788,240 | A | | 8/1998 | Feinberg |
| 5,803,451 | A | | 9/1998 | Kelly et al. |
| 5,816,915 | A | | 10/1998 | Kadlic |
| 5,816,918 | A | | 10/1998 | Kelly et al. |
| 5,823,874 | A | | 10/1998 | Adams |
| 5,823,875 | A | | 10/1998 | Tarantino |
| 5,833,537 | A | * | 11/1998 | Barrie ..... 463/21 |
| 5,833,538 | A | | 11/1998 | Weiss |
| 5,839,960 | A | | 11/1998 | Parra et al. |
| 5,848,932 | A | | 12/1998 | Adams |
| 5,868,618 | A | | 2/1999 | Netley et al. |
| 5,885,157 | A | | 3/1999 | Harada et al. |
| 5,890,963 | A | * | 4/1999 | Yen ..... 463/42 |
| 5,909,875 | A | | 6/1999 | Weingardt |
| 5,938,196 | A | | 8/1999 | Antoja |
| 5,964,463 | A | | 10/1999 | Moore, Jr. |
| 5,984,779 | A | | 11/1999 | Bridgeman et al. |
| 5,988,638 | A | | 11/1999 | Rodesch et al. |
| 6,024,641 | A | | 2/2000 | Sarno |
| 6,062,979 | A | | 5/2000 | Inoue |
| 6,068,552 | A | | 5/2000 | Walker et al. |
| 6,089,977 | A | * | 7/2000 | Bennett ..... 463/20 |
| 6,102,400 | A | | 8/2000 | Scott et al. |
| 6,113,492 | A | * | 9/2000 | Walker et al. ..... 463/16 |
| 6,120,377 | A | | 9/2000 | McGinnis, Sr. et al. |
| 6,120,378 | A | | 9/2000 | Moody et al. |
| 6,123,333 | A | | 9/2000 | McGinnis, Sr. et al. |
| 6,176,781 | B1 | | 1/2001 | Walker et al. |
| 6,183,361 | B1 | | 2/2001 | Cummings et al. |
| 6,213,876 | B1 | | 4/2001 | Moore, Jr. |
| 6,270,411 | B1 | | 8/2001 | Gura et al. |
| 6,286,834 | B1 | | 9/2001 | Caputo |
| 6,305,686 | B1 | | 10/2001 | Perrie et al. |
| 6,315,291 | B1 | | 11/2001 | Moody |
| 6,334,814 | B1 | | 1/2002 | Adams |
| 6,346,043 | B1 | | 2/2002 | Colin et al. |
| 6,364,313 | B1 | | 4/2002 | Moody |
| 6,368,212 | B1 | | 4/2002 | Moody |
| 6,368,214 | B1 | | 4/2002 | Luciano |
| 6,443,837 | B1 | | 9/2002 | Jaffe et al. |
| 6,471,208 | B2 | | 10/2002 | Yoseloff et al. |
| 6,554,703 | B1 | | 4/2003 | Bussick et al. |
| 6,585,588 | B2 | | 7/2003 | Hartl |
| 6,592,457 | B1 | | 7/2003 | Frohm et al. |
| 6,669,559 | B1 | | 12/2003 | Baerlocher et al. |
| 6,800,027 | B2 | | 10/2004 | Giobbi et al. |
| 7,182,690 | B2 | | 2/2007 | Giobbi et al. |
| 2002/0193099 | A1 | | 12/2002 | Paulsen |

FOREIGN PATENT DOCUMENTS

| | | |
|---|---|---|
| GB | 2 098 778 | 11/1985 |
| GB | 2 190 227 | 11/1987 |
| GB | 2 205 188 | 11/1988 |
| GB | 2 253 299 | 9/1992 |
| WO | WO 0103786 | 1/2001 |
| WO | WO 03027970 | 4/2003 |

OTHER PUBLICATIONS

Author Unknown, "Electronic Yahtzee Instructions," Milton Bradley Company, Rev. D., 1995, pp. 1-2.

Author Unknown, "Touch The Technology, The Grand Stand System," Autotote, 1993, 32 pages.

Author Unknown, "Ultimate Yahtzee Sampler," www.hasbro.com/sampler/index.html, Hasbro, 1996, 1 page.

Author Unknown, "Yahtzee Board Game," www.hasbro.com/yahtzee/original/index.html, Hasbro, 1996, 1 page.

Author Unknown, "Yahtzee CD-ROM," www.yahtzee.com, Hasbro, 1996, 2 pages.
Author Unknown, "Yahtzee Instructions—1 or More Players," Milton Bradley Company, 1996, 2 pages.
Brasil Slingo Game Descriptions (1 page), printed from http://onlinegames.slingo.com/ (website) on Sep. 23, 2008.
Burns, B., "The Encyclopedia of Games," Barnes and Noble, Inc. 1998, pp. 198-199.
Creative Computing, Jan.-Feb. 1978 vol. 4, No. 1: Cover page and Contents; pp. 3-4 and 132-137.
Dugdale, S., "Using the Computer to Foster Creative Interaction Among Students," Plato Education Group, CERL, Rpt. E-9, 1979, 19 pages.
Stewart, G., "Commbat: A Tele-Game for Two," BYTE Publications, Inc., Dec. 1981, 3 pages.
Stifle, J.E., "The Plato V. Terminal," Plato Education Group, CERL, Rpt. X-50, Aug. 1977, 64 pages.
Wadlow, T.A., "The Xerox Alto Computer," BYTE Publications, Inc., In the Queue, vol. 6, No. 9, Sep. 1981, 7 pages.
Wasserman, K. and Stryker, T., "Multimachine Games," BYTE Publications, Inc., Dec. 1980, 8 pages.
Wells, A. Baldwin, B. and Quaterman, S., "Documentation for Trek 2.1," Aug. 1979, 20 pages.

* cited by examiner

SYSTEM AND METHOD OF PAUSING AND RESTARTING WAGERING GAMES

CROSS REFERENCE TO RELATED APPLICATIONS

This application is a continuation of U.S. application Ser. No. 11/347,769 filed Feb. 3, 2006 now abandoned, which is a continuation of U.S. application Ser. No. 09/838,949 filed Apr. 19, 2001 now abandoned, which is a continuation-in-part of U.S. application Ser. No. 09/684,759 filed Oct. 6, 2000 now abandoned, which is a continuation-in-part of U.S. application Ser. No. 09/553,915 filed Apr. 20, 2000, now U.S. Pat. No. 6,605,001 issued Aug. 12, 2003, which is a continuation-in-part of U.S. application Ser. No. 09/439,934, filed on Nov. 12, 1999, now U.S. Pat. No. 6,656,047, issued Dec. 2, 2003, which is a continuation-in-part of U.S. application Ser. No. 09/298,604 filed on Apr. 23, 1999 now abandoned, each of which is incorporated herein by reference.

FIELD OF THE INVENTION

The present invention relates generally to methods of playing games, gaming devices and systems.

BACKGROUND OF THE INVENTION

Traditional wager games are configured to accept a wager from a player and present the game to conclusion. If the player does not finish the game, such as by selecting cards to be discarded or drawn in video poker, then the player loses their wager. These games have been favored in the past because it takes little time to present them. Casinos favor this format because games may be played at a very high rate, resulting in a high rate of return to the casino.

Recently, some games have been developed which are longer in duration. These games may have multiple parts, such as a main game and bonus event. These games have the advantage that they are often appealing to players because there is a higher level of player interaction. On the other hand, the format of these games risks that the player may not wish to invest the time necessary to play the game to conclusion, and the player may thus not wish to play the game at all.

SUMMARY OF THE INVENTION

The present invention provides an apparatus and method for playing various casino games. In one or more embodiments the invention comprise a method and system by which a player may pause or save a game in progress and then restart or restore the game at a later time and/or location. In one embodiment, game or game state information may be stored on a magnetic card, bar coded voucher, or other machine-readable medium. In other embodiments, the game or game state information may be stored remotely, such as at a remote server. The remotely stored information may be accessed in a number of ways, such as by use of a player card or voucher.

In accordance with the invention, a player may pause or save a game. Such a step may be initiated by pressing a game pause/save button or by inserting a medium. The game or game state may then be saved to the medium or remotely. In one embodiment, the gaming machine generates information regarding the game or game state, such as the condition of the game. That information is stored on the medium or remotely.

A player may then restart or restore the game. The game may be restarted or restored at the same or a different machine, and at a variety of later times. In one embodiment, the gaming machine obtains the game or game state information, such as from the player provided medium or from the remote location. The gaming machine is then initialized to the conditions and states determined by the saved game information, allowing the player to resume the game from where previously terminated.

In the case where a game's state is saved remote from the gaming machine, information capable of identifying the saved game is issued to the player on a machine-readable medium. When the player inserts or provides the machine-readable medium, the gaming machine is initialized to the saved game state determined by the saved game information on the remote storage device as identified on the machine-readable medium.

The embodiments of the invention have applicability to a wide range of games. The invention has particular applicability to wagering games which may be long in duration or have multiple parts or portions. In accordance with the invention, a player may start the play of a game and then pause that game The player may restart the game at a later time at the same or a different location.

Further objects, features, and advantages of the present invention over the prior art will become apparent from the detailed description of the drawings which follows, when considered with the attached figures.

DETAILED DESCRIPTION OF THE INVENTION

The invention comprises methods and apparatus for presenting and playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention In general, the invention comprises a game, gaming machine and/or gaming system which allows a player to discontinue or pause game play and save the game so that the same game may be resumed at a later time and/or different location. In one or more embodiments, a game is saved by storing game state information on a machine-readable medium. When the medium is later read by a gaming machine, the game is resumed from the saved information stored on the medium.

In alternative embodiments, the game or game state information is stored remotely, such as at a central server with connectivity to the gaming machine. In these embodiments, the game state information may be identified or accessed using access information, such as player issued identifying information. When the player later provides or inputs this identifying information, the associated saved game state information is identified and the game is resumed on whatever gaming machine the player has provided the identifying information.

In one or more embodiments, identifying information is issued to a player on a removable machine-readable medium such as a card or printed voucher. In addition, the identifying information may identify an individual player to identify the player's credit balance, to identify the player in multiple player games (e.g. progressive jackpot games), and to record game statistics (i.e. player tracking).

The ability to pause/save and restart/resume a game is desirable not only because it allows a player to take a break or move to another location and resume the same game later, but also because many games include an element of persistence of play. Persistence of play encourages players to continue playing because each of the player's turns or spins is not a completed game, but rather, part of an ongoing game. Thus, it is highly desirable in persistent games for the player to have the ability to save and later resume a game. The embodiments described below are games which lend themselves to a save and resume function, but games in accordance with this invention need not be the same as those described below. In fact, it is contemplated that the invention be used in games lacking an element of persistence of play. These and other aspects of the invention will become apparent when considering the detailed description below.

Figure 1:
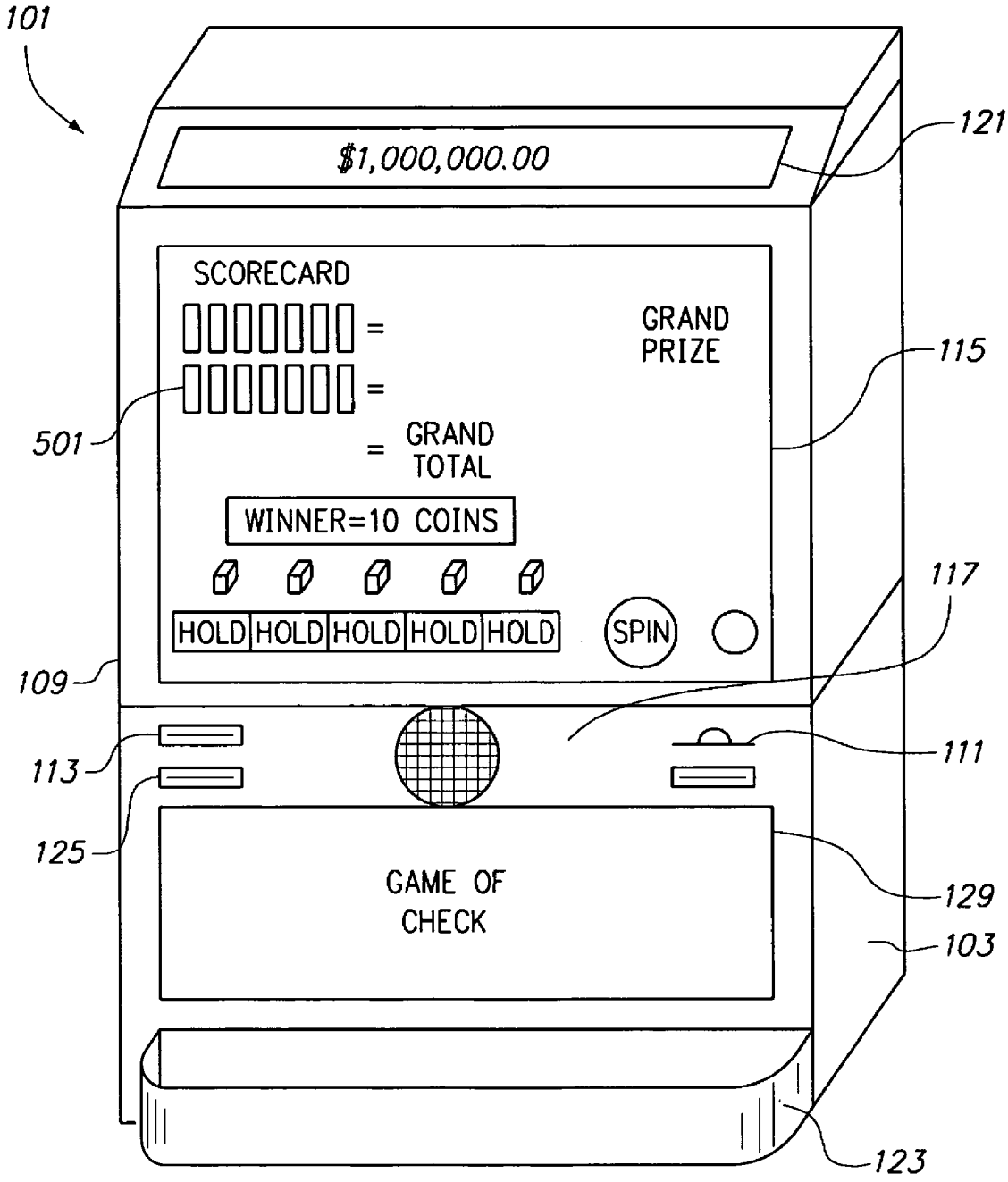
FIG. 1 is a perspective view of a gaming machine in accordance with one embodiment of the a gaming system of the present invention.

In accordance with the invention, one or more games are presented for play on a computer-controlled slot machine or gaming machine, such as illustrated in FIG. 1. As described below, these games may include the games of Check, Z Sixty Six, Z Hot Dice and Z Jackpot Dice. The computer-controlled slot machine 101 includes a microprocessor-controlled computer 103 within a tamper proof and lockable cabinet 109 having a coin acceptor 111 for wagers and a bill validator 113 for wagers, and preferably including a touch-sensitive display 115 for player input and game display. In one or more embodiments, the touch-sensitive display 115 may include a scorecard 501. In addition, the computer-controlled slot machine includes a sound speaker 117 for output of digital sound and voice simulations, a tower light 119 (not shown) to indicate jackpots and other game statistics, and a meter 121 to display progressive jackpot information and other text. The computer 103 controls release of coins to a coin hopper 123 for paying players, and controls a ticket printer 125 for generating vouchers. The computer 103 also controls a machine-readable medium reading and writing device 129 for saving and restoring games in progress.

Figure 2:
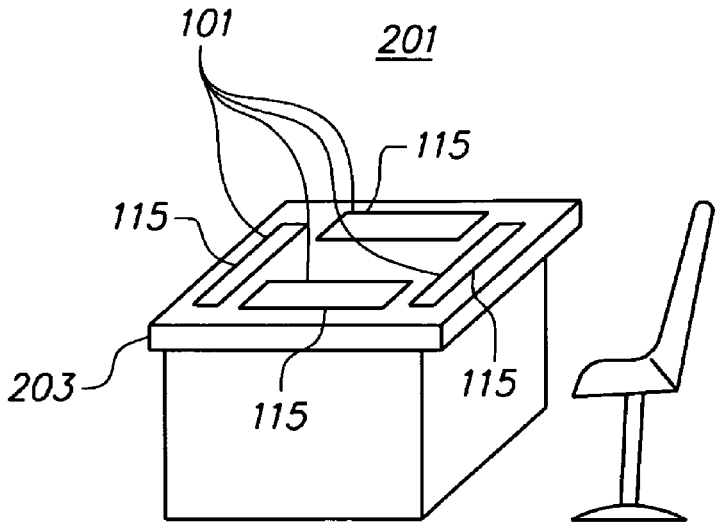
FIG. 2 is a perspective view of four gaming machines assembled in a bar table according to another embodiment of the present invention for single or simultaneous multiple user play.

An alternative embodiment of the computer-controlled slot machine is illustrated in FIG. 2. A "bar buddy" version of a computer-controlled slot machine 201 includes all of the features of the computer-controlled slot machine 101. Each "bar buddy" computer-controlled slot machine 201 contains four such computer-controlled slot machines 101, assembled within a bar table 203. Each of the four touch-sensitive displays 115 for player input and game display are mounted in the surface of the bar table 203. The bar buddy computer-controlled slot machine 201 enables from one to four players to play games of the invention simultaneously, either against each other or against the house. The various modes of game play are detailed below.

Figure 3:
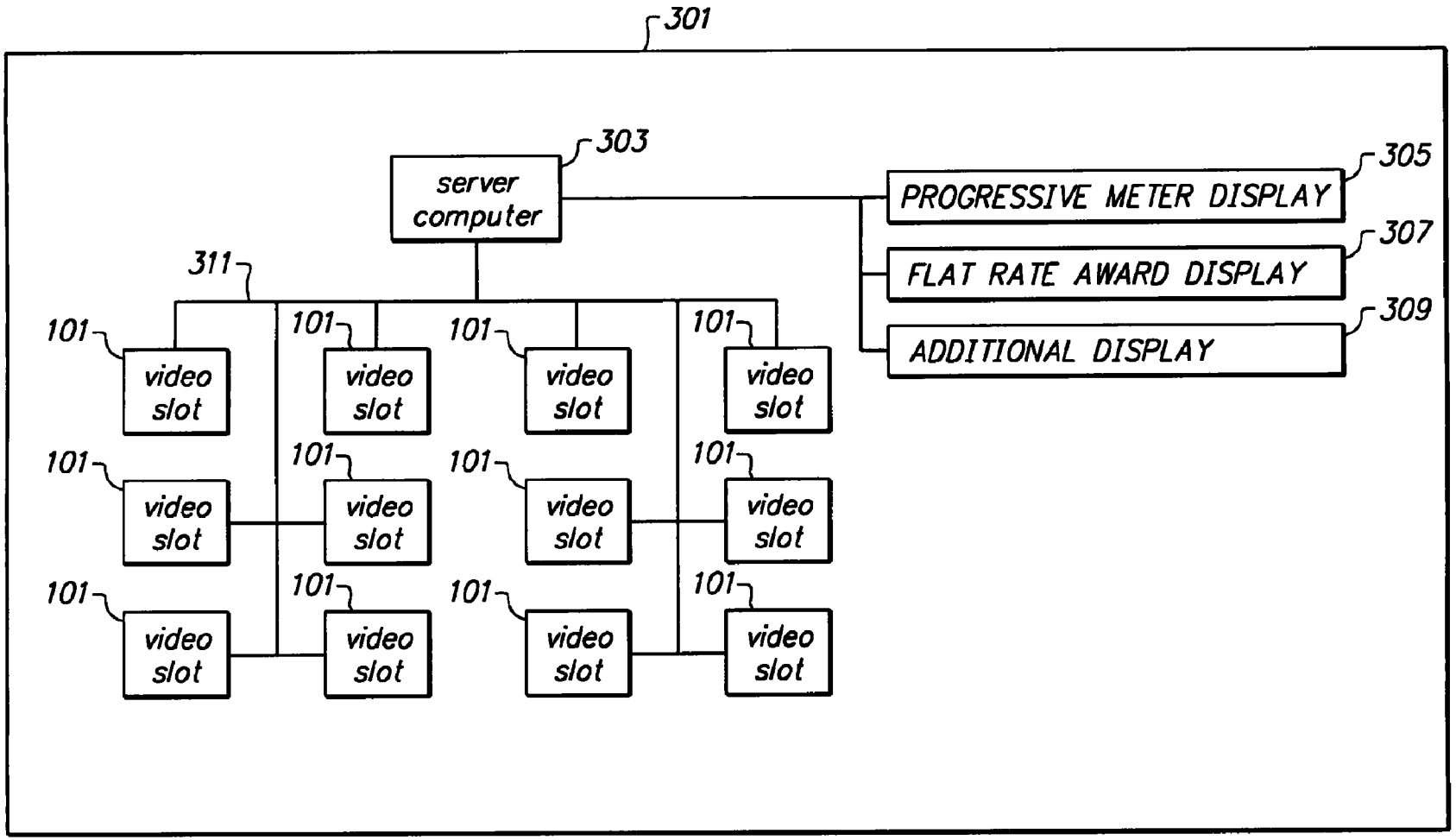
FIG. 3 is a block diagram of a local area network of gaming machines according to the present invention for progressive gaming activity.

Each computer-controlled slot machine 101 is preferably connected to a local area computer network as illustrated in FIG. 3. The local area computer network 301 is controlled by a microprocessor-controlled server computer 303 which controls game play, records game statistics, accounts for vouchers and jackpots, and links the games together. The local area computer network 301 also preferably includes a progressive meter display 305 for showing progressive jackpot information, a flat rate award display 307 for showing flat rate jackpot information, and an additional display 309 for showing the scores that presently qualify for jackpots on the local area network 301. In the preferred embodiment of the present invention, all of the computer-controlled slot machines 101 are connected to the local area computer network 301 in conventional manner via private dedicated lines 311. In an alternative embodiment, some or all of the computer-controlled slot machines 101 positioned at remote locations are connected to the local area computer network 301 via modems and public telephone lines operated in secure mode through encryption/decryption techniques.

Figure 4:
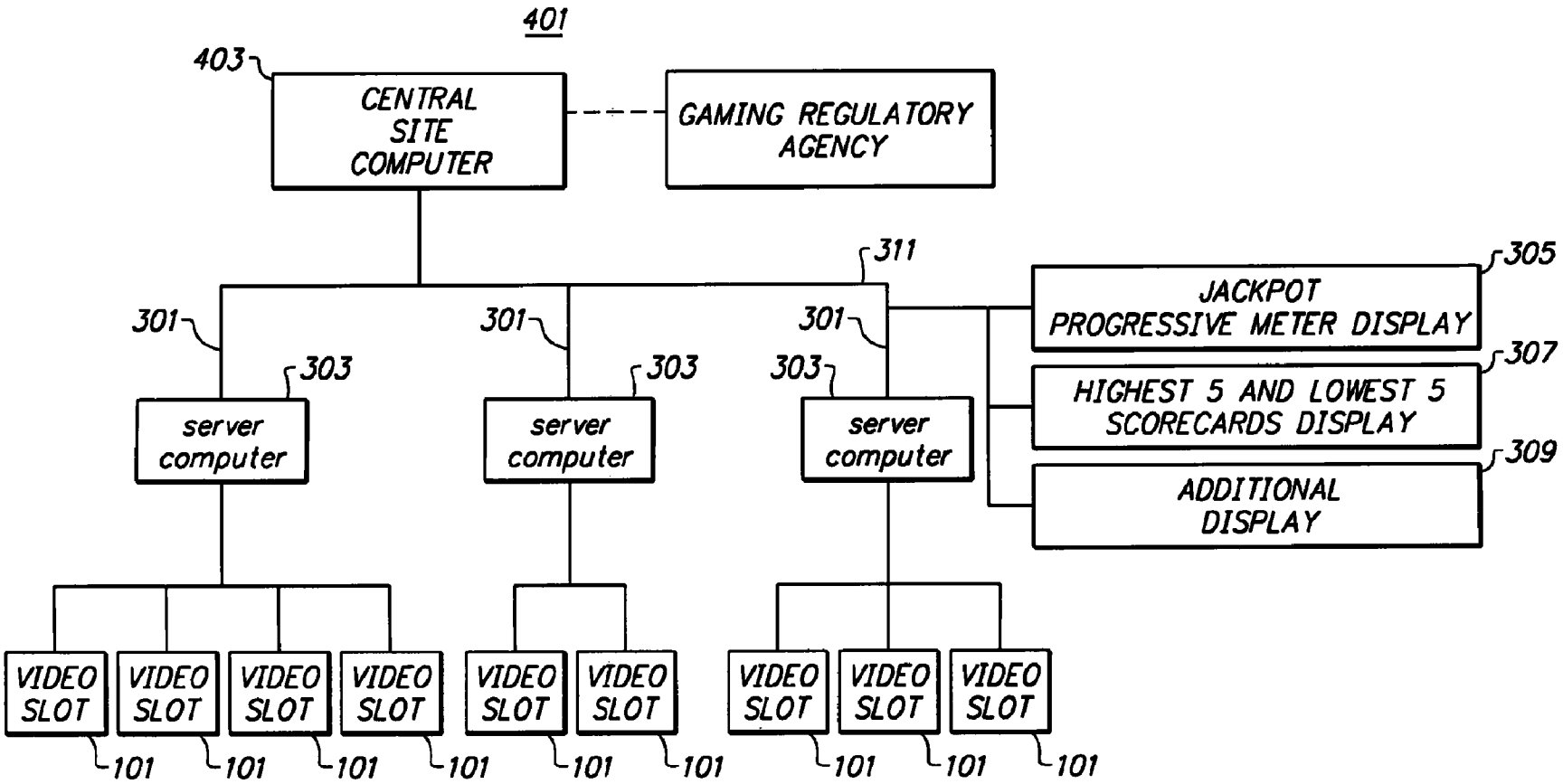
FIG. 4 is a block diagram of a wide area network of gaming machines according to the present invention for progressive gaming activity.

Each local area network 301 of computer-controlled slot machines 101 may be connected to a wide area computer network as illustrated in FIG. 4. The wide area computer network 401 includes local area computer networks 301 at various physical locations. The wide area computer network 401 is controlled by a central-site computer 403 which operates in 24-hour-a-day communication with all local area computer networks 301 on the wide area computer network 401 for security, accounting, and verification of games and jackpots. If a local area computer network 301 is connected to a wide area computer network 401, the progressive meter display 305, the flat rate award display 307, and the additional display 309 of that local area computer network 301 all display jackpot and other information pertaining to the entire wide area network 401. For example, the additional display 309 of a local area computer network 301 which is connected to a wide area computer network 401 shows scores that presently qualify for jackpots on the wide area network 401. In the preferred embodiment of the present invention, each local area computer network 301 is connected to the wide area computer network 401 in conventional secured cryptographic manner via private dedicated lines 311. In an alternative embodiment, some or all of the local area computer networks 301 are connected to the wide area computer network 401 in secured cryptographic manner via modems and public telephone lines.

Figure 5A:
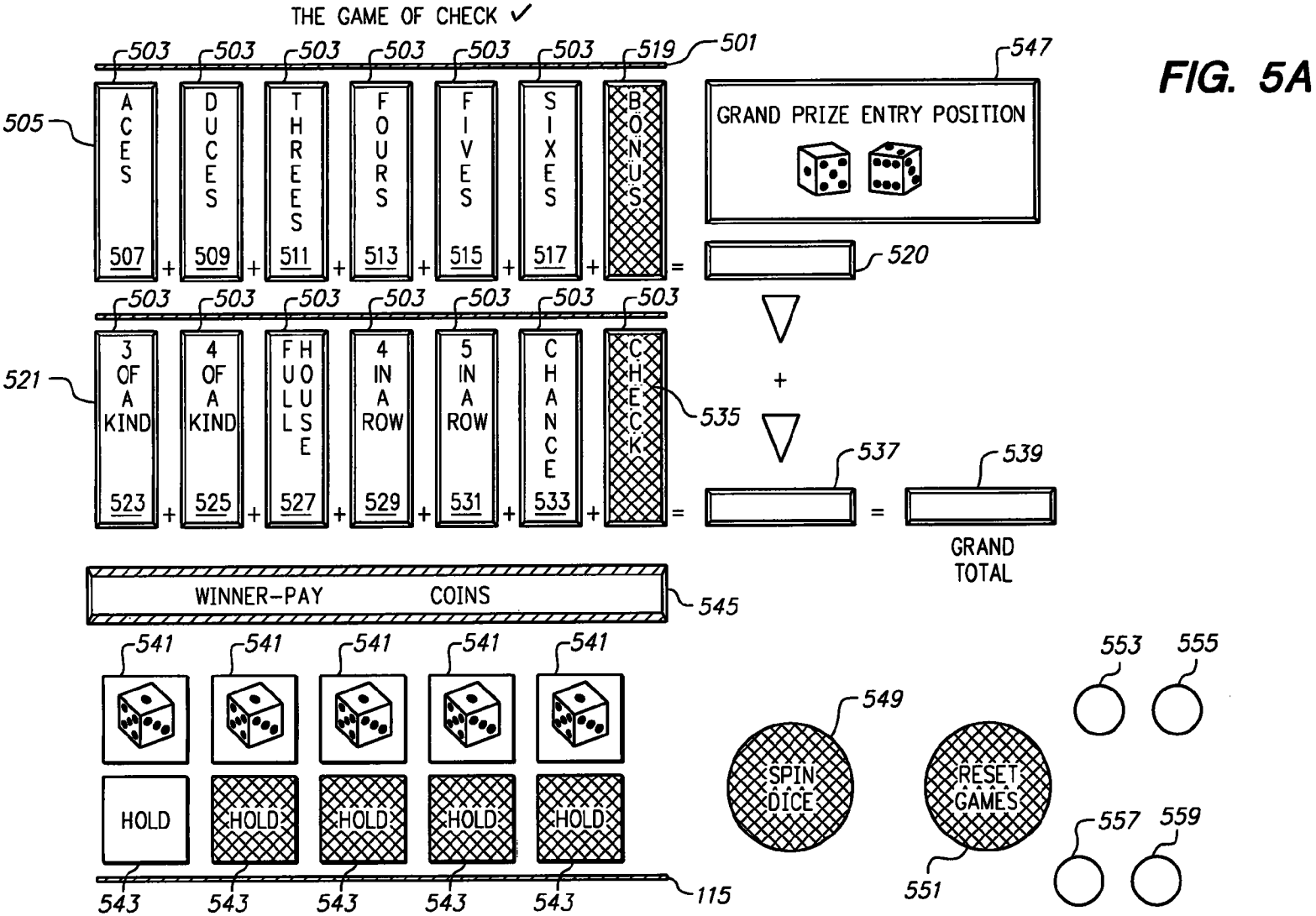
FIG. 5A is a diagram of a touch-sensitive display of a gaming slot machine in accordance with one embodiment of the gaming system of the present invention.

In a preferred embodiment of the present invention, the computer-controlled slot machine 101 includes a touch-sensitive display 15 for player input and game display. FIG. 5A illustrates the layout of the touch-sensitive display in accordance with an embodiment of the present invention for playing the game of Check. The touch-sensitive display 115 allows the player to make input selections conveniently, and displays game information in various ways, depending upon game state. The upper left area of the display 115 displays a scorecard 501 which includes thirteen dual purpose score areas 503 pertaining to the thirteen possible scoring categories. These areas are utilized to accept a player's selection of a scoring category after achieving a scoring spin, and also to display the score achieved by a player in that category, as detailed below with respect to game play.

The computer-controlled display scorecard 501 is divided into two portions. The upper portion 505 of the scorecard 501 includes dual purpose score areas 503 of the display for Ones (or Aces) 507, Twos (or Deuces) 509, Threes 511, Fours 513, Fives 515, and Sixes 517. If the player exceeds a pre-determined score threshold on the upper portion 505 of the scorecard 501, the player is awarded a bonus score which is displayed in the bonus score display area 519 of the upper portion 505 of the scorecard 501. The upper portion 505 of the scorecard 501 also includes an upper portion score total display area 520 for displaying the total of all of the scores achieved in the scoring categories of the upper portion 505 of the scorecard 501. A detailed explanation of scoring is provided below with respect to game play.

The lower portion 521 of the display scorecard 501 includes dual purpose score areas 503 for 3-of-a-Kind 523, 4-of-a-Kind 525, Full House 527, a four-dice Straight 529, a five-dice Straight 531, the sum of all five dice (or Chance) 533, and 5-of-a-Kind (or Check) 535. The lower portion 521 of the scorecard 501 also includes a lower portion score total display area 537 for displaying the total of all of the scores achieved in the scoring categories of the lower portion 521 of the scorecard 501.

The display 115 includes a grand total score display area 539 which displays a player's grand total score as the sum of the upper portion score total and the lower portion score total.

The bottom left area of the display 115 includes five simulated dice 541. The bottom left area of the display 115 includes five hold buttons 543 immediately below the simulated dice 541. These hold buttons 543 are touch-sensitive areas, and are for holding a specific simulated dice 541 on a series of spins (rolls) when the player is attempting to obtain a certain combination, as detailed below with respect to game play.

The middle left area of the display 115 includes a text message box 545 for informing players of games states, such as number of spins remaining, winning combinations, game over, and for informing players of the amount of payouts.

The upper right area of the display 115 includes a message area 547 showing the position of the current scorecard 501 in the daily, weekly, monthly, or yearly prize jackpot award among multiple player networks for the prevailing scores. Alternatively, the message area 547 may show the top five scores on a multiple-player network that qualify for a jackpot, as well as the bottom five scores that so qualify, so that the player can see scores required to achieve a jackpot, as detailed below with respect to jackpots.

The bottom right area of the touch-sensitive display 115 includes a number of touch-sensitive areas which facilitate configuration and control of the game of Check. Specifically, a touch-sensitive spin button 549 activates a spin (roll) of the simulated dice 541, a touch-sensitive reset button 551 resets the scorecard 501, and a touch-sensitive start game button 553 starts a game. A touch-sensitive wager button 555 allows a player to select the number of credits to wager, a touch-sensitive game mode selection button 557 allows a player to switch between game modes, and a touch-sensitive save-restore game button 559 allows a player to save or restore a game in progress to or from a card or voucher of machine-readable medium as further discussed below. Of course, the various buttons or control inputs, for example 543, 549, 551, 553, 555 and 557, described herein as touch-sensitive areas on the display, 115 may also be provided as mechanical electrical input devices, as desired.

Figure 5B:
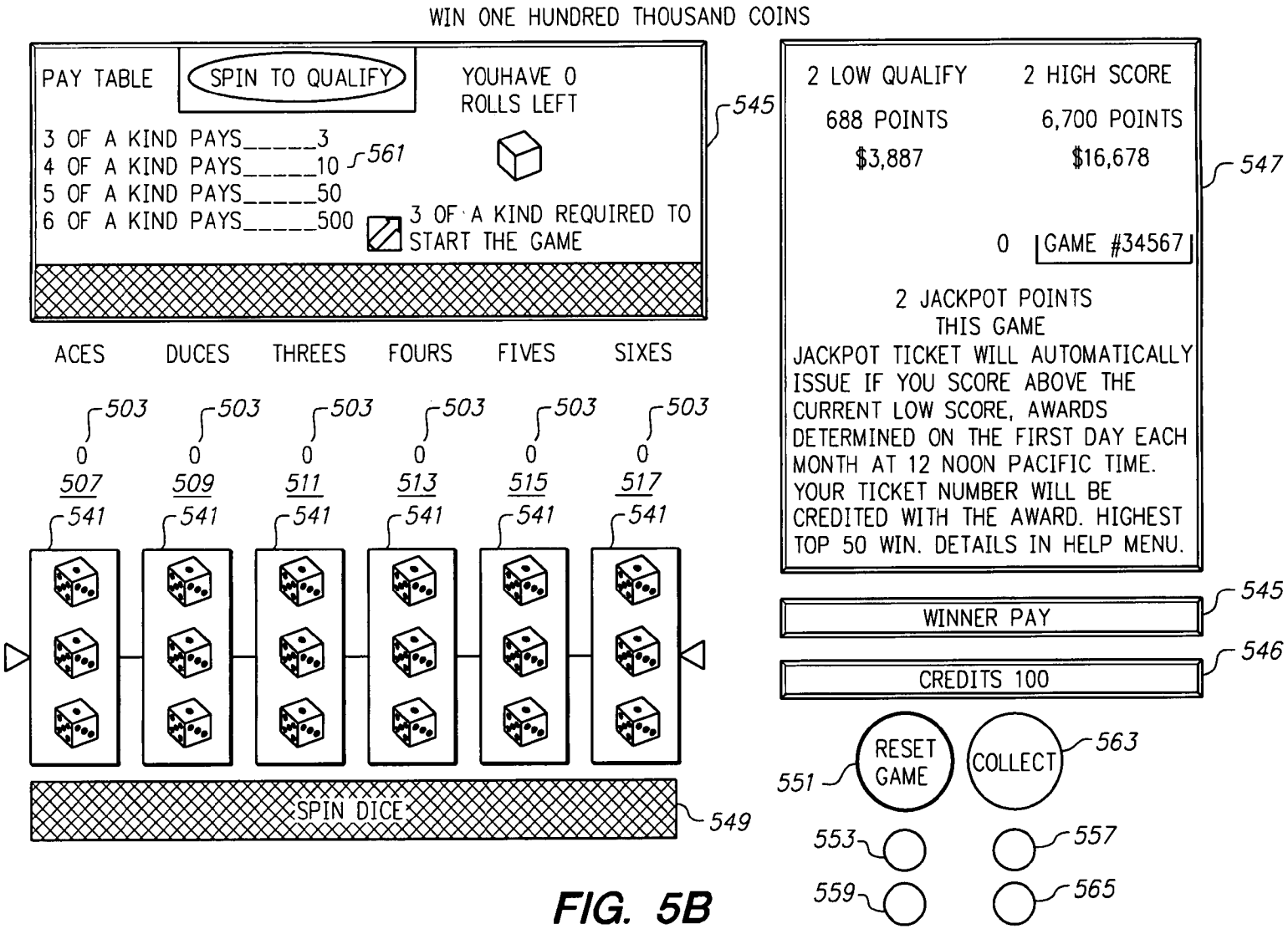
FIG. 5B is a diagram of a touch-sensitive display of a gaming machine in accordance with an alternative embodiment of the gaming system of the present invention.

FIG. 5B illustrates the layout of the touch-sensitive 115 display in accordance with an embodiment of the present invention for playing the game of Z Sixty Six. The touch-sensitive display 115 allows the player to make input selections conveniently, and displays game information in various ways, depending upon game state. The upper left area of the display 115 displays a paytable 561 which indicates predetermined amounts to be paid for achieving specific scoring combinations. The paytable 561 is updated as the game progresses to reflect predetermined amounts to be paid for achieving scoring combinations at different stages of game play.

Below the paytable 561 are six score areas 503 of the display 115. There is a score area for Ones (or Aces) 507, for Twos (or Deuces) 509, for Threes 511, for Fours 513, for Fives 515, and for Sixes 517. Scoring combinations are assigned to appropriate score areas 503. A detailed explanation of scoring is provided below with respect, to game play.

The bottom left area of the display 115 includes six simulated dice 541. In the embodiment shown in FIG. 5B, the simulated dice are in the form of a video simulated dice reels. Below the video simulated dice 541 is a touch sensitive spin button 549 that activates a spin (roll) of the simulated dice 541. In the embodiment illustrated in FIG. 5B, the spin button 549 is in the form of one spin bar common to all simulated dice 541 on the display 115.

The upper central area of the display 115 includes a text message box 545 for informing players of games states, such as number of spins remaining, winning combinations, game over, and for informing players of the amount of payouts. The upper right area of the display 115 includes a message area 547 showing the top score on a multiple-player network that qualifies for a jackpot, as well as the bottom score that so qualifies, so that the player can see scores required to achieve a jackpot, as detailed below with respect to jackpots. Alternatively, the message area 547 may show the position of the current score in the daily, weekly, monthly, or yearly prize jackpot award among multiple player networks for the prevailing scores.

In the embodiment illustrated in FIG. 5B, a text message box 545 for informing players of payout amounts, and a text message box 546 for informing players of the number of accumulated credits are located below the message area 547.

The bottom right area of the touch-sensitive display 115 includes a number of touch-sensitive areas which facilitate configuration and control of the game of Z Sixty Six. A touch-sensitive reset button 551 resets the game, and a touch-sensitive start game button 553 starts a game. A touch-sensitive game mode selection button 557 allows a player to switch single and multiple-player game modes. A touch-sensitive save-restore game button 559 allows a player to save or restore a game in progress to or from a card or voucher of machine-readable medium as further discussed below. A touch-sensitive collect button 563 allows a player to collect accumulated winnings. In one embodiment, a touch-sensitive translate button 565 allows a player to select a language to be used for display output. Of course, the various buttons or control inputs, for example 551, 553, 557, and 559 described herein as touch-sensitive areas on the display 115, may also be provided as mechanical electrical input devices, as desired.

Figure 6:
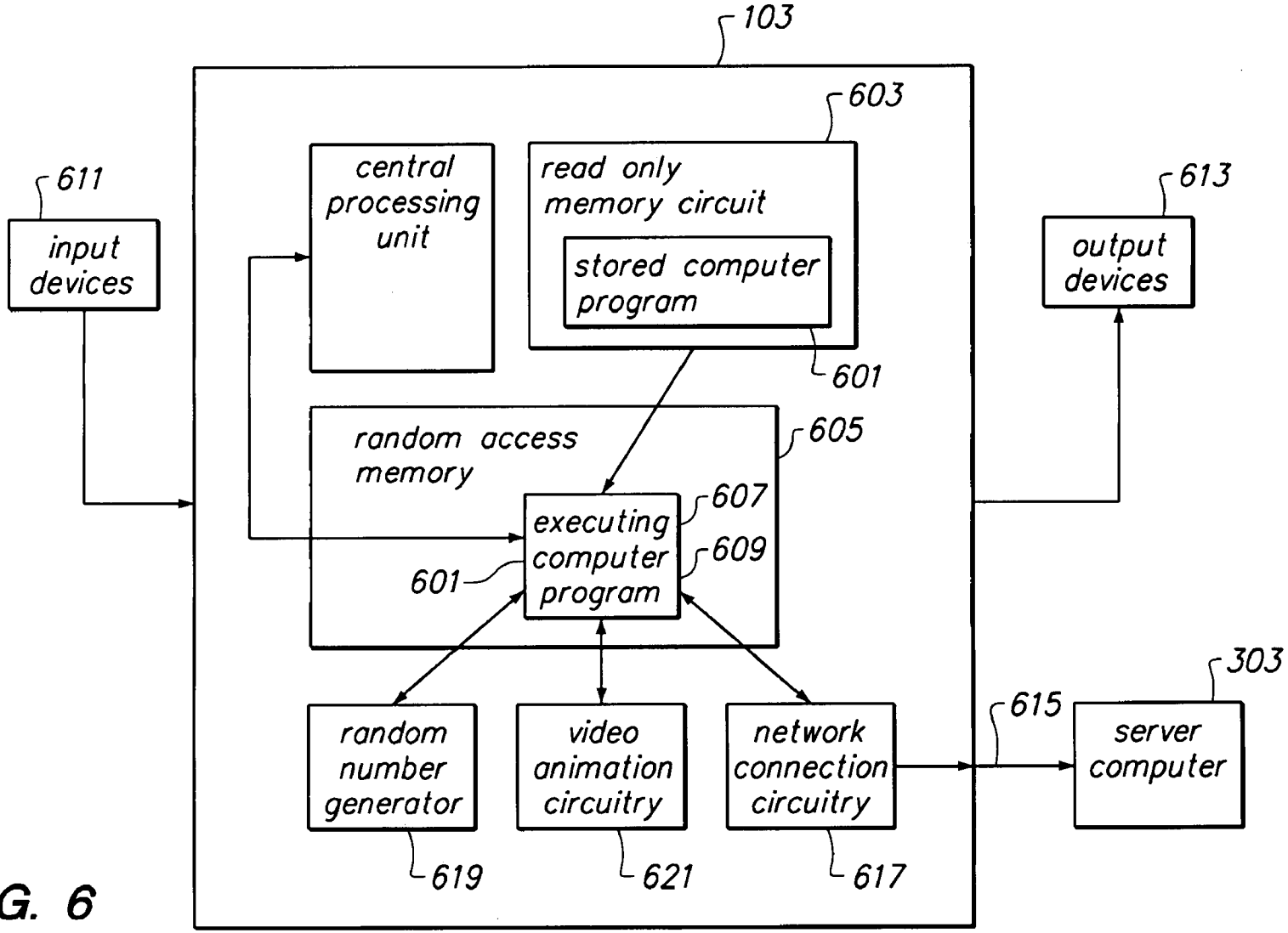
FIG. 6 is a block diagram of the microprocessor-controlled computer and the computer program which facilitate game play according to one embodiment of the present invention.

FIG. 6 illustrates the computer system that facilities game play. In a preferred embodiment of the present invention for playing the game of Check, game play is facilitated by a computer program 601 executing in the microprocessor-controlled computer 103 within the computer-controlled slot machine 101. In the preferred embodiment of the present invention, the computer program is stored on a read-only memory integrated circuit 603 that is operatively coupled to the microprocessor-controlled computer 103 in the computer-controlled slot machine 101. Of course, in alternative embodiments, the computer program may be stored on various other storage media, such as semiconductor memory or optical or magnetic disk, or the like.

The computer program 601 executes from the random access memory 605 of the microprocessor-controlled computer 103 in the computer-controlled slot machine 101, and includes code 607 and data 609 to facilitate the play of the game of Check in accordance with the game rules, as detailed below with respect to game play.

The computer program accepts user input from various user input devices 611 of the types previously described, including coin acceptor 111, bill validator 113, the touch-sensitive display 115, and the machine-readable medium reading and writing device 129. Other input devices including mechanical button type switches and lever-arm switch actuators may be used in alternative embodiments as desired.

The computer program also controls computer operation of the various output devices 613 such as the display 115, the sound speaker 117, a tower light 119, the meter 121, the coin hopper 123, the ticket printer 125, and the machine-readable medium reading and writing device 129.

Preferably, the computer program 601 also controls communication with the microprocessor-controlled server computer 303 which controls the local area computer network 301. The computer program 601 controls this communication via a network port 615 and network connectivity circuitry 617 contained within the microprocessor-controlled computer 103.

The computer program 601 utilizes a random number generator 619 to produce random numbers that represent the results of the simulated rolling of the simulated dice 541. The computer program 601 utilizes animation circuitry 621 to produce the simulation of dice on the display 115.

Figure 7:
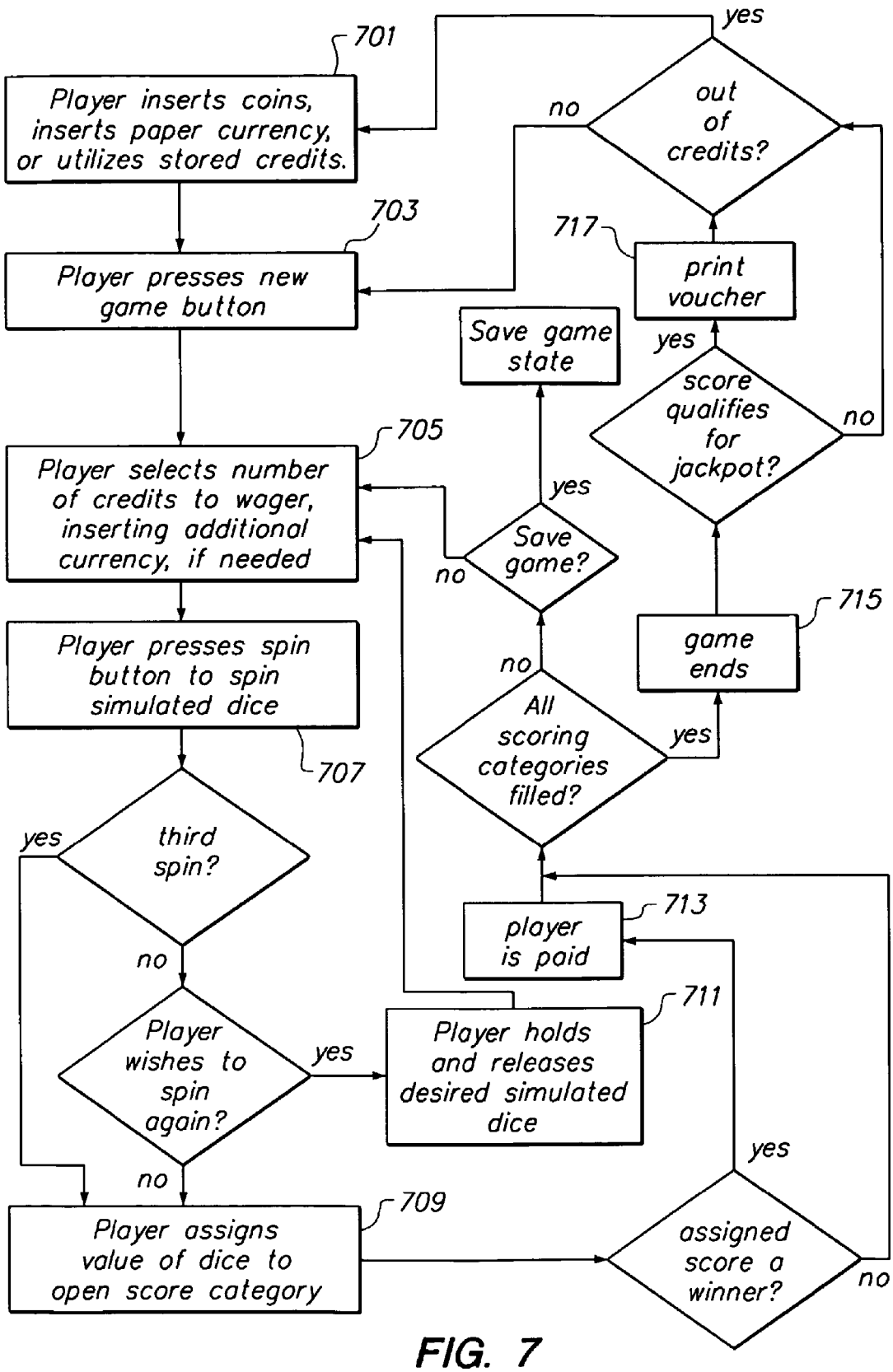
FIG. 7 is a flowchart illustrating the steps of game play according to one embodiment of the present invention.

FIG. 7 is a flowchart, illustrating play of the game of Check according to one embodiment of the present invention. The object of the game is to 'spin' the simulated dice 541 for scoring combinations, and to get the highest total score accumulated within scoring categories of possible dice combinations. A player begins by inserting 701 one or more coins into the coin acceptor 111, by inserting 701 one or more bills into the bill validator 113, or by utilizing credits. The player then presses 703 the touch-sensitive start game button 553 to begin game play. The player then selects 705 the number of credits to wager on the spin of the simulated dice 541 by utilizing the touch-sensitive wager button 555 which controls the selection of the number of credits to be wagered. The player next spins 707 the simulated dice 541 by pressing the touch-sensitive spin button 549. The computer program 601 utilizes the random number generator 619 to produce random numbers that represent the results of the simulated roll of the simulated dice 541.

On each turn, the player may spin 707 the simulated dice 541 up to three times in order to get the highest scoring combination for one of thirteen scoring categories. The thirteen scoring categories are illustrated by the following table:

| | How the Dice Score |
|---|---|
| Upper Portion of Scorecard | |
| One (or Aces) | Total of dice showing One only |
| Twos (or Deuces) | Total of dice showing Two only |
| Threes | Total of dice showing Three only |
| Fours | Total of dice showing Four only |
| Fives | Total of dice showing Five only |
| Sixes | Total of dice showing Six only |
| Bottom Portion of Scorecard | |
| 3-of-a-Kind | Total of all five dice |
| 4-of-a-Kind | Total of all five dice |
| Full House (3 of one number, 2 of another number | 25 |
| Four-Dice Straight | 30 |
| Five-Dice Straight | 40 |
| 5-of-a-Kind (or a Check) | 50 |
| Chance (any five dice) | Total of all five dice |

After each spin the player may assign 709 the value of the simulated dice 541 to one of the possible scoring categories by utilizing the dual purpose score areas 503 of the touch-sensitive display 115. If a player does so, the computer under program control senses the touched areas 503 and totals the value of the simulated dice 541 and calculates and displays the resulting score in the dual purpose score area 503 on the touch-sensitive display 115. The total score of the upper portion 505 of the scorecard 501 is displayed on the upper portion score total display area 520 on the touch-sensitive display 115. If the total score of the upper portion 505 of the scorecard 501 is 63 or higher, for example, then a bonus of 35 points, for example, is added to the upper portion score. This bonus is displayed on the bonus score display area 519 on the display 115. The total score of the lower portion 521 of the scorecard 501 is displayed on the lower portion score total display area 537 on the display 115. The grand total score is calculated by adding the upper portion and the lower portion scores together. The grand total score is displayed on the grand total score display area 539 on the display 115.

Each scoring category can only be scored or selected once during a game. Once a category is used, it cannot be reused until the next game either when the game is over because the scorecard 501 is complete or the player presses the touch-sensitive reset button 551. Pressing the touch-sensitive reset button 551 clears the entire scorecard 501 in preparation for the start of a new game.

Instead, if the player has not yet spun 707 three times during the present turn, the player may elect not to assign 709 the value of the simulated dice 541, but instead to spin 707 again. If the player elects to spin 707 again, the player may hold 711 one or more of the simulated dice 541 by pressing one or more of the associated hold button(s) 543. The player may also release 711 one or more of any held simulated dice 541 by again pressing the associated hold button(s) 543. The player may also elect not to hold or release 711 any of the simulated dice 541. The player then selects 705 the number of credits to wager on the spin of the simulated dice 541 by utilizing the touch-sensitive wager button 555. The player next spins 707 the simulated dice 541 by pressing the touch-sensitive spin button 549.

A turn is over after a player has spun 707 three times, or has assigned 709 the value of the simulated dice 541 to one of the possible scoring categories by utilizing the dual purpose score areas 503 of the touch-sensitive display 115. After a player has spun 707 three times, the player must assign 709 the value of the simulated dice 541 to one of the possible scoring categories by utilizing the dual purpose score areas 503 of the touch-sensitive display 115. If the score cannot be placed into one of the categories because it does not correspond or qualify, then the player must utilize the dual purpose score areas 503 of the touch-sensitive display to assign 709 a zero to one of the remaining categories.

If the player has achieved a scoring combination and assigns 709 it to one of the scoring categories, the player is paid 713 via the coin hopper 123. Alternatively, the player may elect to receive credits. The computer program 601 calculates payment according to a paytable, which is based upon points scored per turn, and the number of spins needed to achieve the points, as shown, for example, in the following table:

| | NUMBER OF COINS | | |
|---|---|---|---|
| CATEGORY | ×3 Spin 1 | ×2 Spin 2 | ×1 Spin 3 |
| ONES | TOTAL × 3 | TOTAL × 2 | TOTAL OF 1's |
| TWOS | TOTAL × 3 | TOTAL × 2 | TOTAL OF 2's |
| THREES | TOTAL × 3 | TOTAL × 2 | TOTAL OF 3's |
| FOURS | TOTAL × 3 | TOTAL × 2 | TOTAL OF 4's |
| FIVES | TOTAL × 3 | TOTAL × 2 | TOTAL OF 5's |
| SIXES | TOTAL × 3 | TOTAL × 2 | TOTAL OF 6's |
| 3 of a Kind | TOTAL × 3 | TOTAL × 2 | TOTAL × 1 |
| 4 of a Kind | TOTAL × 3 | TOTAL × 2 | TOTAL × 1 |
| Full House | 75 | 50 | 25 |
| Small Straight | 90 | 60 | 30 |
| Large Straight | 120 | 80 | 40 |
| Chance | TOTAL × 3 | TOTAL × 2 | TOTAL × 1 |
| Check | 150 | 100 | 50 |
| Check Bonus 1 | 300 | 250 | 100 |
| Check Bonus 2 | 300 | 200 | 100 |
| Check Bonus 3 | 300 | 200 | 100 |

| SCORECARD BONUSES | |
|---|---|
| TOP HALF 63+ POINTS | +35 COINS |
| ALL CATEGORIES FILLED | +100 COINS |
| SCORE 250-299 PTS. | +50 COINS |
| SCORE 300-349 PTS. | +100 COINS |
| SCORE 350-399 PTS. | +150 COINS |
| SCORE 400-449 PTS. | +200 COINS |
| SCORE 450-499 PTS. | +250 COINS |
| SCORE 500-549 PTS. | +300 COINS |
| SCORE 550-599 PTS. | +350 COINS |
| SCORE 600-644 PTS. | +400 COINS |
| PERFECT SCORE | +6000 COINS |

If the player assigns 709 a zero score to one of the categories, the player is not paid. Alternative embodiments may employ different paytables, as desired.

The player may then proceed with the next turn and continue filling the scorecard 501, or the player may save the game. To save the game, the player activates the save-restore button 559 which initiates a process allowing the player to leave the game and resume the same game at a later time as described in more detail below. To proceed with the next turn, the player utilizes the touch-sensitive wager button 555 to select 705 the number of credits to be wagered on the spin of the simulated dice. The player next spins 707 the simulated dice 541 by pressing the touch-sensitive spin button 549 and plays a turn, as described above. The game ends 715 when the player has filled all thirteen categories with a score or a zero or is out of credits to play the computer-controlled slot machine 101.

Once the game has ended, the computer program 601 evaluates the player's scorecard 501 against other current scores to determine if a progressive jackpot will be awarded on a daily, weekly, monthly, or yearly basis. If the player has a currently qualifying scorecard 501, the computer-controlled slot machine 101 prints 717 a voucher for the player with a control number and other pertinent information for later redemption, if the scorecard 501 is a winner.

Utilizing a local area computer network 301 and a wide area computer network 401, multiple players may play the game of Check against one another instead of "against the house." Utilizing a local area computer network 301, each participating player deposits money into an individual computer-controlled slot machine 101 for each spin. The player who achieves the highest scorecard 501 of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

Figure 8:
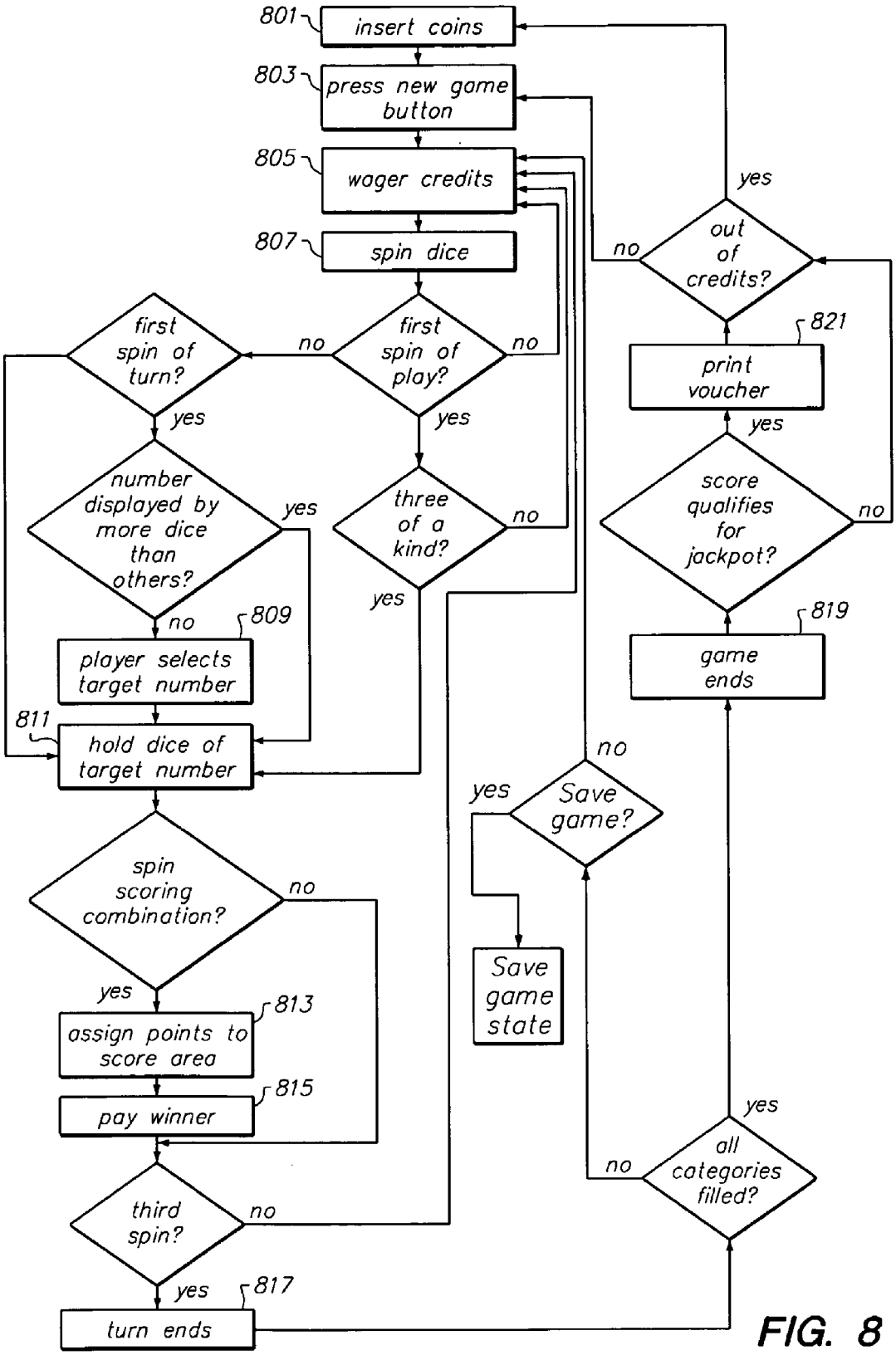
FIG. 8 is a flowchart illustrating the steps of game play according to an alternative embodiment of the present invention.

FIG. 8 is a flowchart, illustrating play of the game of Z Sixty Six according to one embodiment of the present invention. The object of the game is to 'spin' the simulated dice 541 for scoring combinations, and to get the highest total score accumulated within scoring categories of possible dice combinations. A player begins by inserting 801 one or more coins into the coin acceptor 111, by inserting 801 one or more bills into the bill validator 113, or by utilizing credits. The player then presses 803 the touch-sensitive start game button 553 to begin game play. In one embodiment, three credits are automatically wagered 805 on each spin of the simulated dice 541. In another embodiment, the player selects the number of credits to wager on the spin of the simulated dice 541 by utilizing the touch-sensitive wager button 555 which controls the selection of the number of credits to be wagered. The player next spins 807 the simulated dice 541 by pressing the touch-sensitive spin button 549. The computer program 601 utilizes the random number generator 619 to produce random numbers that represent the results of the simulated roll of the simulated dice 541.

The player must achieve at least three of a kind on a single spin to begin play of an individual game. Until a spin generates at least three simulated dice 541 displaying identical numbers, the player must continue spinning 807 to attempt to generate the minimum achievement required for game entry. A wager is required for each spin of the simulated dice 541. Once a spin generates at least three simulated dice 541 displaying identical numbers, those simulated dice 541 are automatically held 811, and a predetermined number of points is automatically assigned 813 to the appropriate scoring area 503. The number of points awarded is displayed in the appropriate score area 503, which preferably changes color to indicate active status, for example as illustrated in the Appendices A1 to A36 attached hereto and formed a part hereof. The spin that generated the requisite achievement is counted as the first spin of a turn, and the scoring number becomes a target number for the remainder of the turn. A target number is a number that the player can receive points for generating during a given turn.

For example, if a first spin results in four aces (ones), the predetermined number of points for achieving four of a kind on the first spin of a first turn is automatically assigned 813 to the scoring area 503 for aces 507. Aces becomes the target number for the remainder of the turn. Thus, on the subsequent spins of the turn, the player will receive additional points only for generating aces.

The requirement of generating at least three of a kind applies only to the first turn. A player must achieve three of a kind to enter the game and begin the first turn. Once a player has generated the requisite achievement and entered the game, subsequent turns do not require a minimum achievement to begin.

On each turn, the player may spin 807 the simulated dice 541 up to three times in order to get the highest scoring combination for one of six scoring categories. The six scoring categories are illustrated by the following table:

| Score Category | How the Dice Score |
|---|---|
| One (or Aces) | Dice showing One only |
| Twos (or Deuces) | Dice showing Two only |
| Threes | Dice showing Three only |
| Fours | Dice showing Four only |
| Fives | Dice showing Five only |
| Sixes | Dice showing Six only |

After the first spin of a turn, the number displayed by the largest plurality of the video simulated dice 541 automatically becomes the target number for the current turn. The simulated dice 541 of the target number are automatically held 811, and the score area 503 for the target number preferably changes color to indicate that it is the active score area 503 for the turn. If at least three dice 541 displaying the target number have been generated, a predetermined number of points is assigned 813 to the score area 503 for the target number.

If the first spin does not result in a largest plurality of dice 541 displaying any one number, the player selects 809 a target number from amongst those displayed by an equal number of the simulated dice 541. For example, if the first spin results in two aces, two deuces, one four and one five, the player may select 809 acres or deuces as the target number. The selection is made by touching the desired score area 503 of the touch-sensitive display 115. Preferably, the score areas 503 which the player may touch to choose a target number blink or change color or size or otherwise provide visual indication of the choices available.

If the player has not yet spun 807 three times during the present turn, the player may spin 807 again. The player next spins 807 the simulated dice 541 by pressing the touch-sensitive spin button 549. During the second and third spins of a turn, any generated dice 541 displaying the target number are held 811. Preselected numbers of points are assigned 813 to the appropriate scoring area 503 for scoring three, four, five, or six of the target number.

After each spin, if the player has achieved a scoring combination, the player is paid 815 via the coin hopper 123. Alternatively, the player may elect to receive credits. The number of predetermined points awarded for various scoring achievements is displayed in a paytable 545 on the display 115. The paytable 545 is adjusted as the game progress, reflecting predetermined numbers of points to be paid for various achievements at a particular stage of the game. For example, more points are awarded for achieving a six of a kind on a first spin than on a third spin. Amounts to be paid are based upon the odds of achieving various scoring combinations at a given stage of game play, taking into account number of unheld dice to be spun, and numbers removed from possible generation. An example of paytable 545 for a first spin of a game appears below.

| ACHIEVEMENT | NUMBER OF POINTS TO BE PAID |
|---|---|
| THREE OF A KIND | 3 |
| FOUR OF A KIND | 10 |
| FIVE OF A KIND | 50 |
| SIX OF A KIND | 500 |

Alternative embodiments may employ different paytables 545, as desired.

A turn ends 817 after a player has spun 807 three times, or achieved six of the target number prior to the third spin.

Each scoring category can only be scored or selected once during a game. Once a category is used, it cannot be reused until the next game either when the game is over because a score has been assigned to each category, or the player presses the touch-sensitive reset button 551. Pressing the touch-sensitive reset button 551 terminates the current game and starts a new game. Once a scoring category for a given number has been used, that number is replaced for the remainder of the game by a non-numerical symbol, for example the letter "Z" or a graphic symbol of a piece of fruit, or as desired. During subsequent turns, when the random number generator 619 generates the used number, the non-numerical symbol is displayed instead.

After completing a turn, the player may then proceed with the next turn and continue filling the score areas 503, or the player may save the game. To proceed with the next turn, the player next spins 707 the simulated dice 541 by pressing the touch-sensitive spin button 549 and plays a turn, as described above. To save the game, the player activates the save-restore button 559 which initiates a process allowing the player to leave the game and resume the same game at a later time as described in more detail below.

The game ends 819 when the player has filled all six score areas 503 with a score, or is out of credits to play the computer-controlled slot machine 101.

Figure 9:
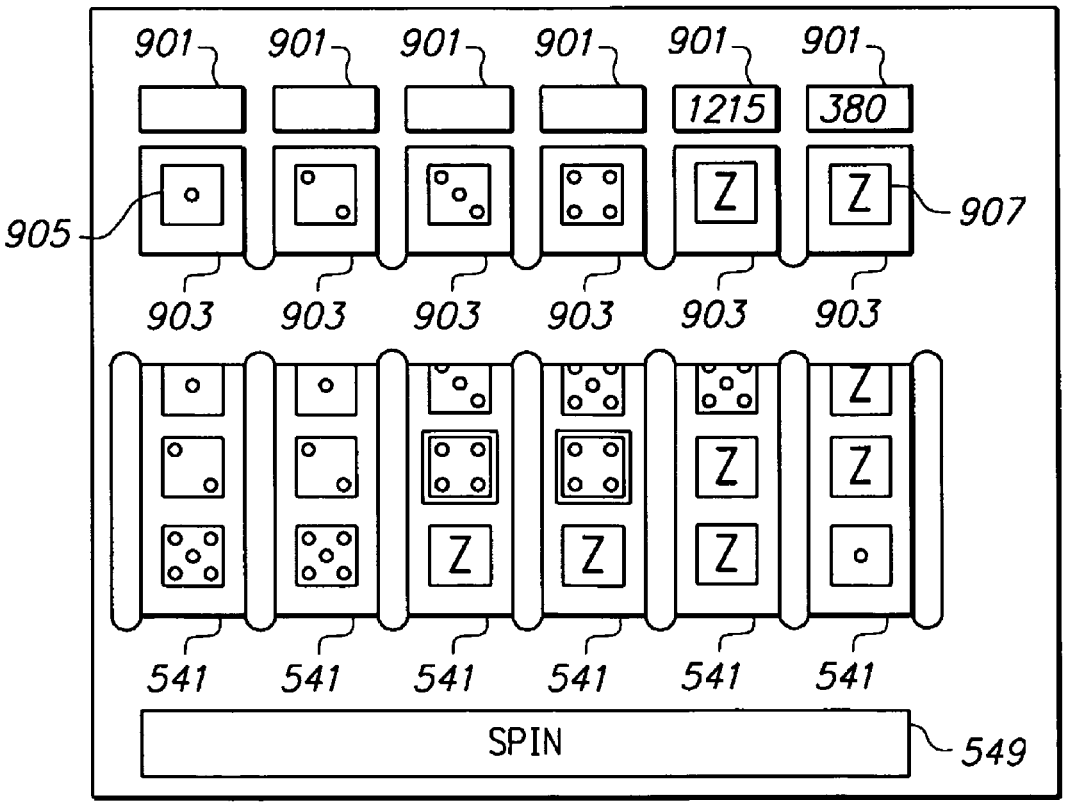
FIG. 9 is illustrates score categories comprising two distinct display areas, according to one embodiment of the present invention.

FIG. 9 illustrates an embodiment of the present invention in which each score area 503 comprises two distinct display areas. A first display area 901 is utilized to display accumulation of points for the associated scoring category. A second display area 903 identifies the associated scoring category, for example by displaying an identification video simulated dice 905 displaying the number of the scoring category. Additionally, the second display area 903 is used to indicate a current target number for a turn, preferably by changing color to indicate that the number of the associated scoring category is the active target number. Also, the second display area 903 is preferably utilized to choose a target number from amongst those displayed by an equal number of the simulated dice 541 when necessary. The player chooses a target number by touching the second display areas 903 associated with the chosen target number. The second display area 903 which the player may touch to choose a target number blink or change color or size or otherwise provide visual indication of the choices available. Additionally, once a scoring category for a given number has been filled, the indicator for the associated second display area is replaced for the remainder of the game by a non-numerical symbol 907, for example the letter "Z" or a graphic symbol of a piece of fruit, or as desired.

In alternative embodiments, display of accumulated points, identification of score category, indication of current target number, indication of available choices of target number, and indication of filled categories (and in other embodiments more or fewer functions as desire) are divided between at least two display areas, in various combinations as desired.

Once the game has ended, the computer program 601 evaluates the player's score against other current scores to determine if a progressive jackpot will be awarded on a daily, weekly, monthly, or yearly basis. If the player has a currently qualifying score, the computer-controlled slot machine 101 prints 821 a voucher for the player with a control number and other pertinent information for later redemption, if the score is a winner. In various embodiments, jackpots are awarded for achieving high scores, for achieving high scores low scores, or for achieving both high and low scores as desired.

Figure 10:
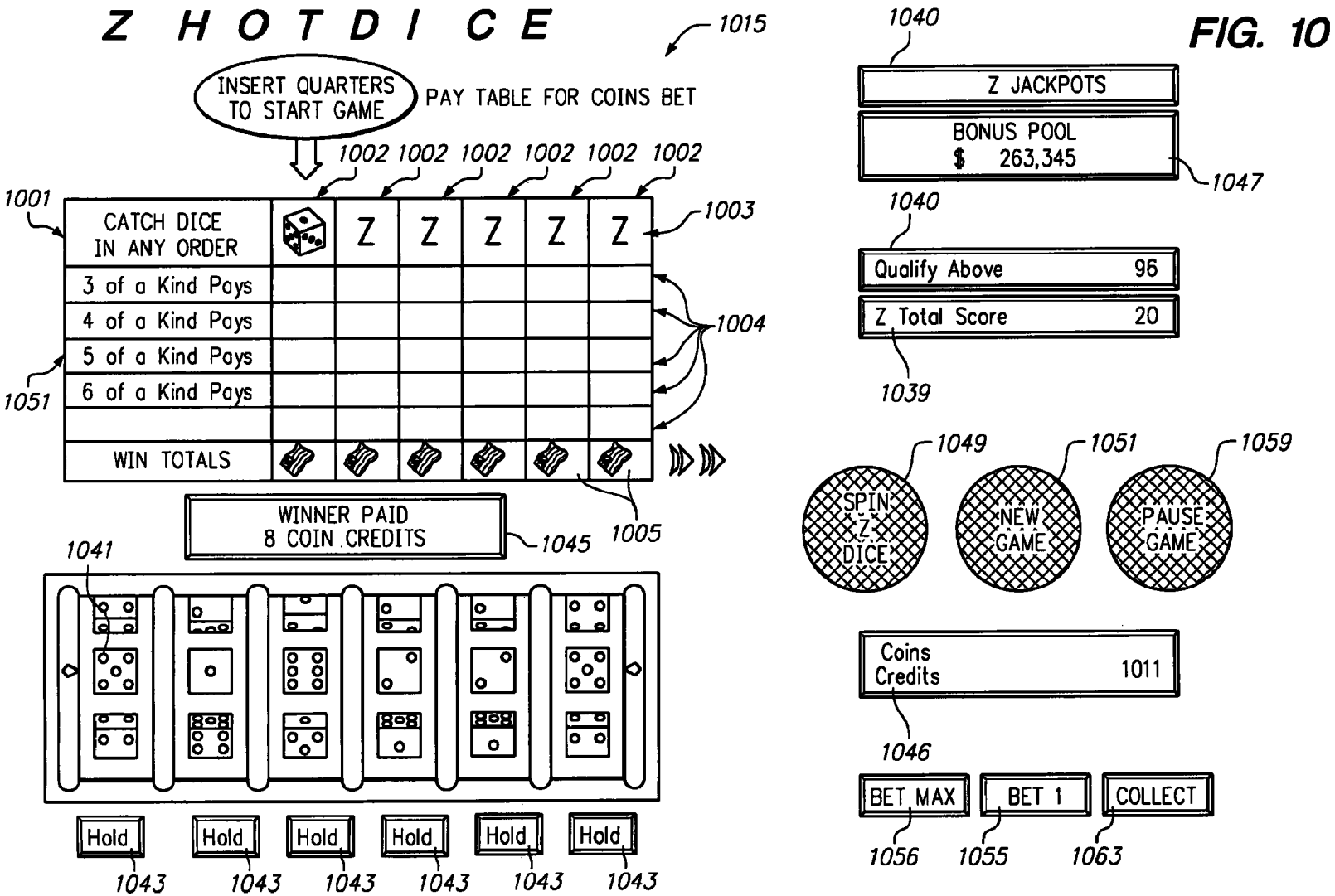
FIG. 10 illustrates a user-interface for an alternate game of the present invention.
Figure 11:
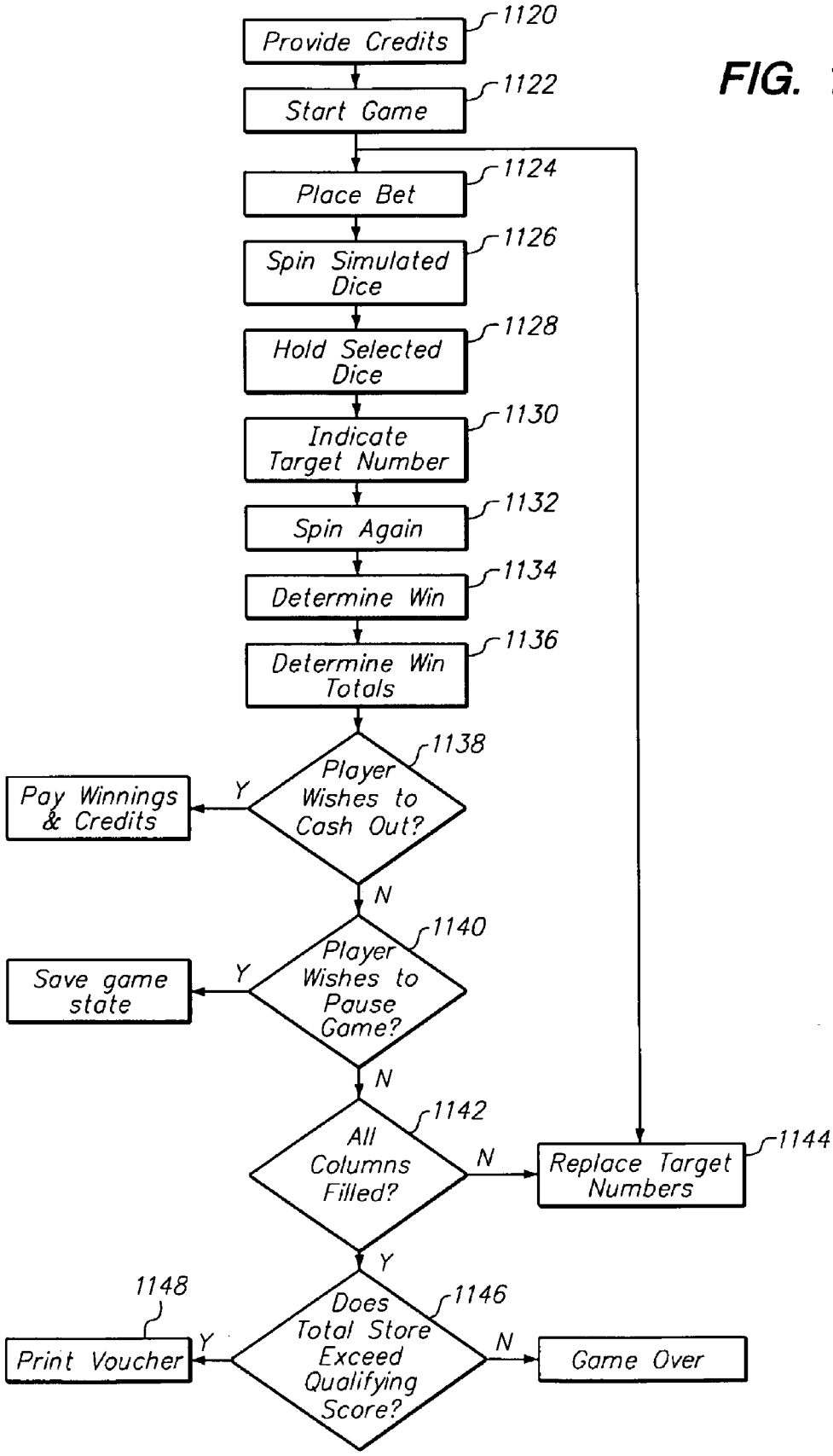
FIG. 11 is a flowchart illustrating the steps of game play of the game having the interface illustrated in FIG. 10.

Another embodiment of a game of the present invention will be described with reference primarily to FIGS. 10-11. This game is referred to herein as the game of Z Hot Dice. FIG. 10 illustrates a touch sensitive display 1015 for implementing the game of Z Hot Dice. A scorecard 1001 area is provided in an upper left-hand corner. The scorecard 1001 displays information regarding a particular event, the pay table for that event, prior played events, and win totals for each prior played event and the current event.

The scorecard 1001 includes six columns 1002, the number of columns being the same as the number of sides of dice. During game play, as described below, a target number is associated with one of the columns 1002, the target numbers comprising one of the numbers associated with a side of a dice (i.e. the numbers one through six). At a top of each column 1002 is provided a target number indicator 1003. In one embodiment, before a target number has been selected, this indicator 1003 displays a "Z" or other symbol (or nothing). A central portion 1004 of each column 1002 indicates the payout which will be awarded to a player for receiving a particular combination of the target number(s).

In the embodiment illustrated, the central portion 1004 is arranged to display payouts for receiving 3 of a Kind, 4 of a Kind, 5 of a Kind or Six of a Kind of the target number. A win total 1005 is provided at the bottom of each column 1002 for indicating the total payout or winnings to the player for a particular event. Those of skill in the art will appreciate that other winning combinations may be provided, such as a full house (i.e. three of the target number along with two of another number).

The display 1015 displays a number of simulated dice 1041, in a similar manner to that described above. Below each simulated dice area 1041 is a hold button 1043. Each button 1043 is associated with one of the simulated dice 1041 and, as described in more detail below, arranged to permit a player to "hold" the a particular simulated dice 1041 in a fixed position.

A number of other display areas are provided for displaying game information. For example, a message area 1047 is provided for displaying the amount of winnings in a jackpot pool. A grand total area 1039 is provided for indicating to the player their total score for the win totals 1005 of all columns 1002. In addition, a qualify score 1040 is displayed so that the player may determine if his or her grant total is sufficiently high to qualify for a bonus or jackpot (as described below).

A new game button 1051 is provided for permitting a player to begin a new game. As described in more detail below, once a player has placed a wager, a text messages area 1045 displays winnings paid or other information for a player. The player may bet or wager credits in single increments with a "Bet 1" button 1055, or may bet or wager a maximum allowed number of credits using a "Bet Max" button 1056. A credits area 1046 displays the credits belonging to the player.

A spin button 1049 is provided for permitting a player to effectuate a spin of the simulated dice 1041. A pause game button 1059 is provided for permitting a player to pause a game in progress. A player may elect to cash out by pressing a collect button 1063.

As described in more detail below, while in one arrangement the user interface or screen comprises a touch screen arranged to display information to a player and receive input therefrom, the user interface may comprise a combination of electrical and mechanical devices. For example, one or more of the buttons may comprise electromechanical buttons which may be depressed by a player. Those of skill in the art will appreciate that many players like the "tactile" feel of buttons as compared to touch screen input. Further, while the display areas are discussed separately, they may be integrated or be arranged in a number of ways other than as shown.

A method of play of the game of Z Hot Dice will be described with reference to FIG. 11. In a first step 1120, a player inserts a number of coins or provides other consideration for playing the game. The consideration may be dollar bills, credits from a player card or the like.

In a step 1122, the player presses the new game button 1051 to initiate a new game. In one or more embodiments, the gaming apparatus is configured such that if the player presses the new game at any time during the pendency of a game, the player is prompted to press the new game button again if the player actually intends to start a new game. This serves to reduce the likelihood that the player may accidentally or unintentionally press the new game button 1051 and cause a new game to begin. The prompt message may be illuminated in the text message box 1045.

In a step 1124, the player places a wager or bet. In one embodiment, this step comprises the player pressing the "Bet 1" button 1055 or the "Bet Max" button 1056. In one embodiment, a player is permitted to bet between one and five credits. Each credit may comprise any of a number of values, such as $0.05 U.S., $0.10 U.S., $0.25 U.S. or the like. The player may utilize the "Bet 1" button 1055 to place wagers incrementally, or press the "Bet Max" button 1056 to place a maximum bet. The payouts displayed on the central portions 1004 of the columns 1002 may be updated, as necessary, to reflect an increased payout for achieving a predetermined winning combination when the player increases the amount wagered.

In a step 1126 the player presses the spin button 1049. Upon depressing the spin button 1049, the simulated dice 1041 spin or move (such as in a motion simulating a "reel" displaying die faces), and then stop, as described above to simulate the random roll of dice.

At this point, six simulated die 1041 are displayed to the player, each dice 1041 displaying one face, and thus one number, towards the player. In the arrangement illustrated in FIG. 10, the simulated die 1041 display a five, a one, a six, a two, another two, and another five.

In a step 1128, the player is then permitted to "hold" the dice which that player wishes to play. The held dice identify a selected target number, the target number being that number shown on the face of the held dice. For example, in the arrangement illustrated in FIG. 10, the player may elect to hold the simulated die 1041 displaying fives. In such event, the player presses the right-most and left-most buttons 1043, and the target number then comprises five.

In a step 1130, when the player makes a selection, the target number is displayed in the first available column 1002 of the scorecard 1001. In one embodiment, the first available column comprises the left-most column 1002 which has not been utilized during the game. Preferably, the target number is illustrated by replacing the "Z" or other symbol in the indicator 1003 with a dice displaying the target number. In the example given above, a dice displaying a five would be displayed in the left-most column 1002.

In one or more embodiments, a player is not permitted to select as a target number a number which has already been played in a particular game. If the player attempts to do so, a message may be displayed in the text message box 1045 to the effect that the selected number has already been played and the player must either select a new target number or spin again. Another spin may be required where the first spin does not result in the display of any available target numbers (as described below, after a target number has been played, it is preferably removed from the simulated die 1041 and will not be re-displayed). In addition, if the player selects more than one number (such as a simulated dice 1041 displaying a five and another displaying a two) the player be instructed that the action is not permitted and the player must select only one target number.

Preferably, when a number is selected, the particular column 1002 is highlighted, such as in brightness or a different color, to aid the user in identifying which information is pertinent to the present round of the game.

In one or more embodiments, the particular payout is dependent upon the player's wager, with the payout increasing with an increasing wager. Set forth below are possible paytables for wagers of one, two, three, four and five coins or bet increments for each target number. As will be appreciated, the payout increases as the number of target numbers played increases (for reasons described below).

If after the first spin and hold, the player has a winning combination of simulated dice 1041, then the win total is indicated in the win total area 1005 of the scorecard 1001, and the text message box 1045 may indicate the winnings. For example, in the event upon the first spin of the game the spin results in four simulated dice 1041 showing a five, then the player may hold these four simulated dice for a "4 of a Kind" of a target number of fives. The payout for this combination may then be indicated in the win total area for the first column 1002, and the text message box 1045 indicate the winnings to be paid.

In one embodiment, payouts for combinations of target numbers which are eliminated may be removed from the scorecard 1001. For example, in the above-referenced example, the payout for a 3 of a Kind may be removed from the first column 1002, since the player has already received at least a 4 of a Kind. In addition, the payout which the player has already received upon the first spin for that target number may be highlighted to bring to the attention of the player that he or she has already won. This highlighting may be by displaying the payout in a distinguishing color or brightness or other means available. The word "paid" may be indicated in the particular area of the scorecard 1001 as well.

In accordance with the present invention, in a step 1132, after holding one or more of the simulated dice 1041, or after an indication that no dice can be held, then the player presses the spin button 1049 again. All of the simulated dice 1041 which were not held spin and then stop, again displaying a number.

In a step 1134, the total number of simulated dice 1041 displaying the target number after the second spin are then counted for determining whether a payout is to be awarded. A win total is displayed in the win total area 1005 of the particular column. This win total may be 0, in the event the player did not receive a sufficiently high number of simulated dice 1041 displaying the target number (for example, a player may elect to hold two dice showing the target number after the first spin and not receive any additional dice showing the target number after the second spin, thus not receiving a minimum three of the target number for an award). The payout for that "round" may then be updated in the text message box 1045.

In a step 1136, the win totals from all win total areas 1005 are summed and displayed as a total score in the total score area 1039. Preferably, a qualifying score for a jackpot bonus is displayed in the qualifying score area 1040, again which the player may compare their score.

In a step 1138 it is determined if the player wishes to cash out. This is indicated by a player pressing the collect button 963. In such event, any accumulated winnings and credits are paid to the player. In that event, the game ends.

In a step 1140, it is determined if the player wishes to pause the game. If the player wishes to pause the game, the player pushes the pause game button 1059. A process is then initiated by which the player may leave the game and being play at a later time and even at different gaming machine, as described in more detail below.

If the player wishes to continue the game, it is determined in a step 1142 if all of the columns 1002 of the scorecard 1001 are filled. If so, then the player has completed the game. In a step 1146, the player's total score is compared to the qualifying score to determine if the player qualifies for participation in the jackpot. If the player qualifies, then in a step 1148, the player is provided with a voucher or the like, in similar manner to that described above with respect to the game of Z Sixty Six.

In a step 1144, after a particular target number has been played in a round, that target number is replaced on each simulated dice 1041 with another symbol or is removed. As described above, this may be a symbol, such as a "Z," or a picture of a fruit or the like. In one embodiment, it is preferred that the replacement symbols be different so that at no time can a player receive a sequence of the same symbols during a spin. Such may be confusing to a player and lead a player into believing that they have spun into a winning combination. For example, the replacement symbols may comprise an X on the first simulated dice 1041, an O on the second simulated dice 1041, an X on the third simulated dice 1041 and so on, so that if a player spins and the simulated dice stop on the replacement symbols, they display XOXOX.

In another embodiment, the replacement symbols may actually be arranged so that a player may spin into a new bonus combination for which a payout is awarded. For example, each number or dice face may be replaced with a $ symbol, such that during later play if the player receives a display of all of these symbols after a spin, the player is awarded a special prize or payout.

If all of the columns 1002 of the scorecard 1001 are not filled, the player may, repeating again to step 1124, place a bet or wager. The player may be provided with an indication in the text message box 945 after a given round that they may place a bet to continue with the game.

The game then continues as described above. It will be appreciated that after a first target number has been played, a spin of the simulated dice 1041 may result in a display of all of the remaining numbers and/or the symbols used to replace the already played target number. As the number of played numbers increases, the probability of receiving a target number decreases. For this reason, as detailed above, the payout for receiving a winning combination of each target number increases as the game progresses.

The player may continue playing until each of the target numbers one through six, have been played (in any order). At such time, the total score for the player is compared to the qualifying score to determine if the player is entitled to participate in a jackpot or additional play. Regardless of the outcome, the player must then begin a new game to continue play.

Another embodiment of a game of the present invention will be described with reference primarily to FIGS. 12-13. This game is referred to herein as the game of Z Jackpot Dice.

Figure 12:
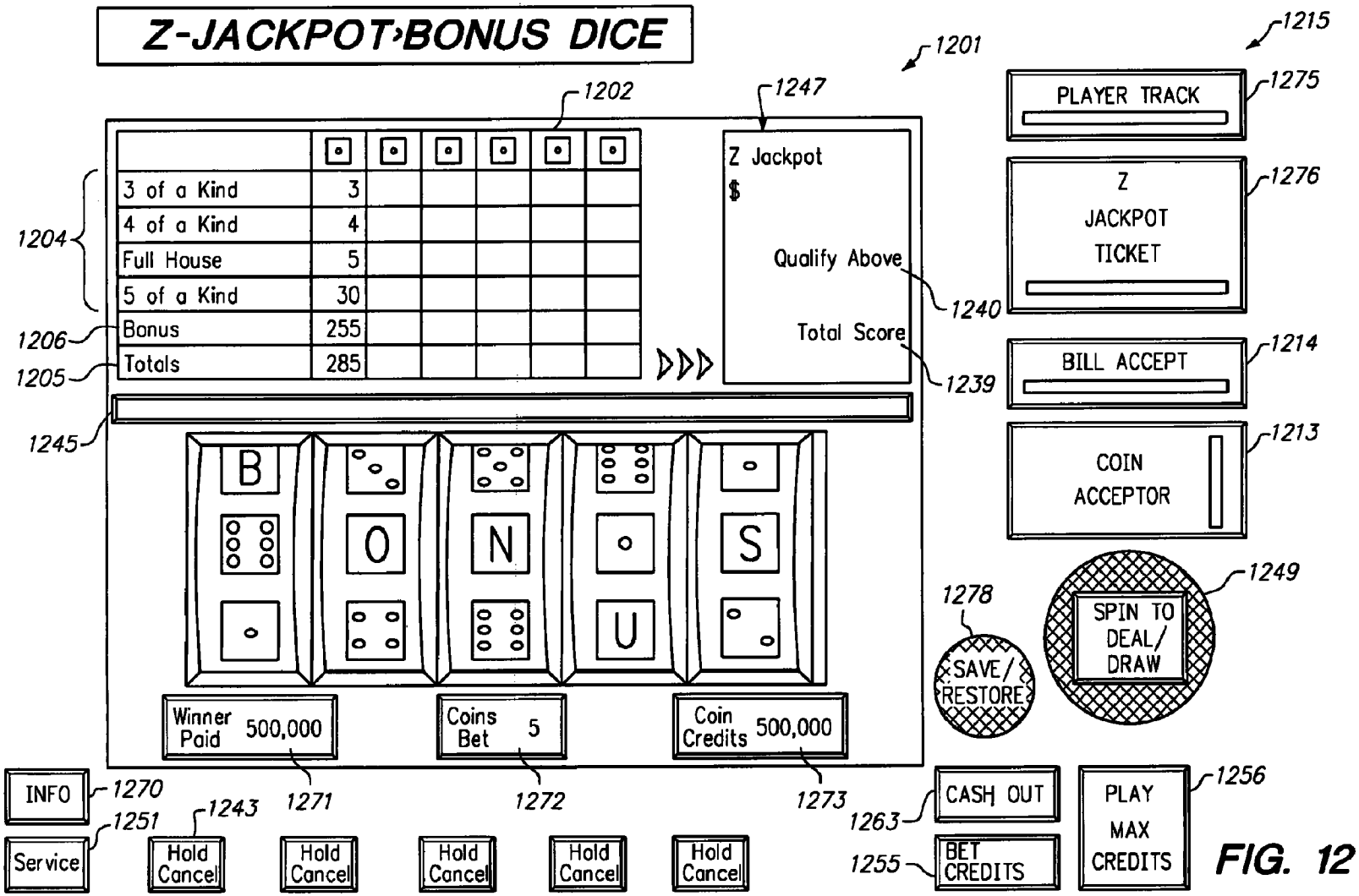
FIG. 12 illustrates a user-interface for an alternate game of the present invention.
Figure 13:
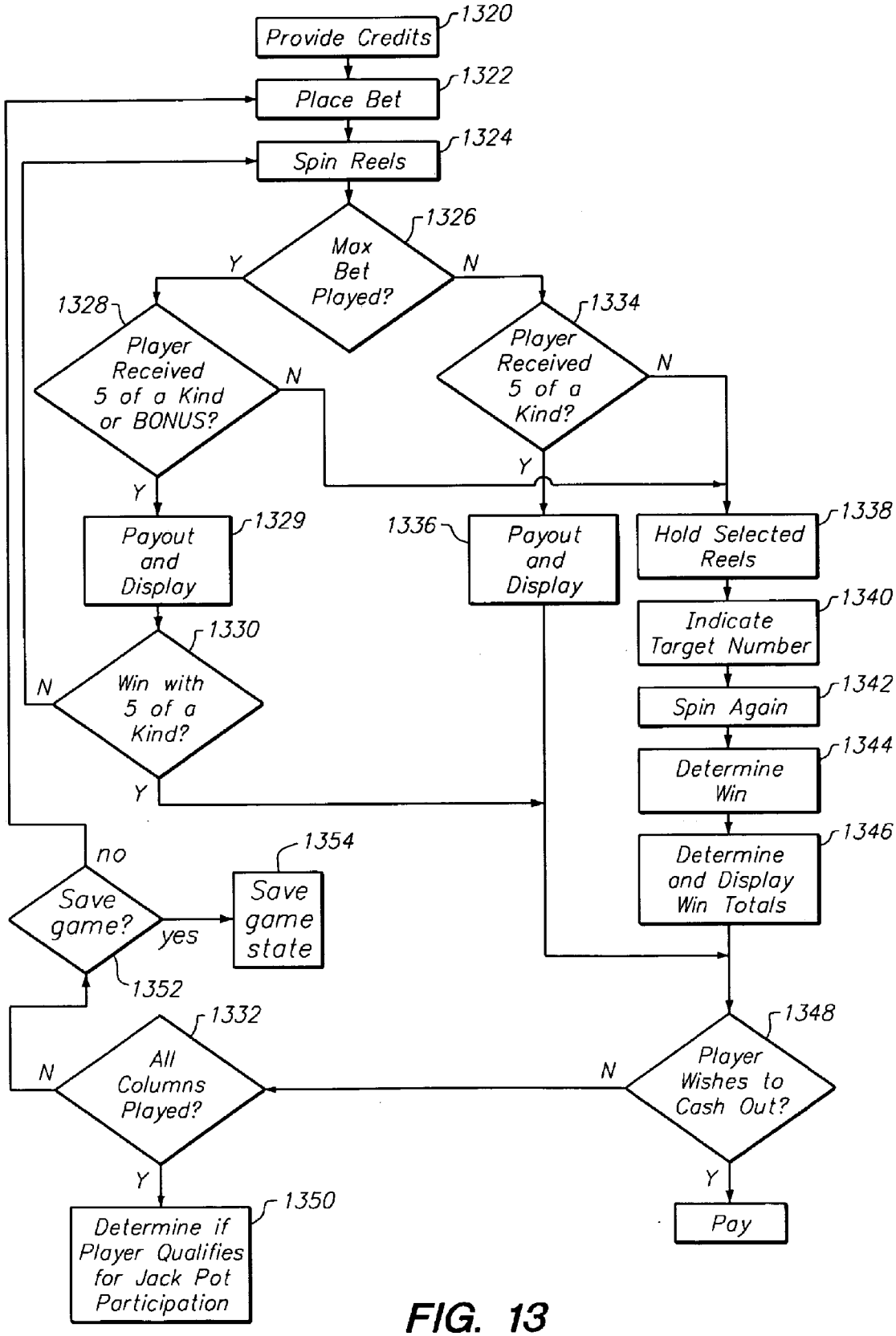
FIG. 13 is a flowchart illustrating the steps of game play of the game having the interface illustrated in FIG. 12.

FIG. 12 illustrates an interface 1215 for implementing the game of Z Jackpot Dice. A scorecard 1201 area is provided in an upper left-hand corner. The scorecard 1201 displays information regarding a particular play event, the pay table for that event, prior played events, and win totals for each prior played event and the current event.

The scorecard 1201 is similar to that of the previous embodiment in many respects, and includes six columns 1202, one for each of the six sides of a dice and the numbers associated therewith. At a top of each column 1202 is provided a target number indicator 1203. In one embodiment, before a target number has been selected, this indicator 1203 comprises a blank dice. A central portion 1204 of each column 1202 indicates the payout for a particular combinations of the target number and/or other numbers. As illustrated, the central portion 1204 is arranged to display payouts for receiving 3 of a Kind, 4 of a Kind, and 5 of a Kind of the target number, as well as a full house, a full house comprising three of the target number and a pair of another number. Preferably, the payouts for all combinations are illustrated in the central portion 1204, regardless of whether a particular column 1202 is active (as described below). However, it is desired that the payout information for the non-active column to be displayed less brightly or less visibly than the information provided in the active column. In this manner, a player is provided with information regarding the possible payouts for receiving combinations in any particular column, but the player's attention is directed to the active column 1202 so as to avoid the player being confused as to which column 1202 is being played.

A bonus value 1206 is provided in the column 1202. The bonus value 1206 comprises a payout value which the player may win in a manner described in more detail below. In a preferred embodiment, the bonus value 1206 comprises a sum which is related to the amount of wagers placed by players when playing the game, such as a percentage of the wagers or retained winnings by the game provider/house.

A win total 1205 is provided at the bottom of each column 1202 for indicating the total payout or winnings to the player for a particular event.

The interface 1215 also includes a number of reels 1241. In the preferred embodiment of this game, five reels 1241 are provided. In a preferred embodiment, each reel 1241 is capable of displaying one of nine symbols: one symbol each comprising a side of a dice, and three symbols comprising a letter in three different colors. Thus, each reel 1241 is capable of displaying dice sides having a one, two, three, four, five and six thereon. The first reel is preferably arranged to display the letter "B" in the colors of red, white and blue. The second reel is preferably arranged to display the letter "O" in the colors of red, white and blue. The third reel is preferably arranged to display the letter "N" in the colors of red, white and blue. The fourth reel is preferably arranged to display the letter "U" in the colors of red, white and blue. The fifth reel is preferably arranged to display the letter "S" in the colors of red, white and blue.

It will be appreciated that the reels 1241 may comprise a displayed image on a video display. In one or more other embodiments, the reels 1241 may comprise mechanical reels having one or more of the images printed thereon and/or capable of being displayed thereon. In general, each reel 1241 is arranged to simulate a throw or spin of an imaginary nine-side dice having sides displaying the above-described numbers and symbols. Thus, as one aspect of the invention, dice or similar physical items are represented either graphically or on a physical reel.

Below each reel 1241 is a hold button 1243. Each button 1243 is associated with one of the reels 1241 and, as described in more detail below, arranged to permit a player to "hold" the position of a particular reel 1241 in a fixed position.

A number display areas are provided for displaying related game information. For example, a message area 1247 is provided for displaying the amount of winnings in a jackpot pool. A grand total area 1239 is provided for indicating to the player the total score of the win totals 1205 of all columns 1202. In addition, a qualify score 1240 is displayed so that the player may determined if his or her grant total is sufficiently high to qualify for a bonus or jackpot as described below.

A new game button 1251 is provided for permitting a player to begin a new game. As described in more detail below, once a player has placed a wager, a text messages area 1245 may be used to display information, such as game play information. The game play information may be accessible by pressing an information button 1270.

Display areas are provided for displaying winner paid information 1271, bet information 1272, and credit information 1273. The player may bet or wager credits in single increments with a "Bet 1" button 1255, or may bet or wager a maximum allowed number of credits using a "Bet Max" button 1256.

A spin button 1249 is provided for permitting a player to effectuate a spin of the simulated dice 1241. A player may elect to cash out by pressing a cash out button 1263. A player may elect to save or restore a game by pressing a save-restore button 1278.

As illustrated, a coin acceptor 1213 and bill acceptor 1214 are provided for accepting wagers by a player. A player card reader 1275 is provided for reading a player card. The player card 1275 may contain credits which can be used to place bets, may contain player information for reading by the machine, and may store game information, such as a qualifying score, as described in more detail below. A ticket dispenser 1276 is provided for dispensing tickets. As described in detail below, the ticket information may comprise game information, such an in-progress or completed game information.

A method of play of the game of Z Jackpot Dice will be described with reference to FIG. 13. In a first step 1320, a player inserts a number of coins (as by coin acceptor 1213), bills (as by bill acceptor 1214) or provides other consideration for playing the game. Consideration may also comprise credits from a player card or the like.

In a step 1322, the player places a wager or bet. In one embodiment, this step comprises the player pressing the "Bet 1" button 1255 or the "Bet Max" button 1256. In one embodiment, a player is permitted to bet between one and five credits. Each credit may comprise any of a number of values, such as $0.05 U.S., $0.10 U.S., $0.25 U.S. or the like. The player may utilize the "Bet 1" button 1255 to place wagers incrementally, or press the "Bet Max" button 1256 to place a maximum bet.

In a step 1324 the player presses the spin button 1249. Upon depressing the spin button 1049, the reels 1241 spin or move (either by mechanical rotation or by computer generated graphics) and then stop. At this point, one symbol is displayed in association with each reel 1241. In the arrangement illustrated in FIG. 12, the symbols six, white O, blue N, one and red S are displayed.

In a step 1326, it is determined if the player placed the maximum bet. If so, then in step 1328 it is determined if the player has received a specific combination of displayed symbols on the reels 1241. In one or more embodiments, a player is declared a winner if the player receives the symbols spelling BONUS. In one embodiment, if the player receives the symbols spelling BONUS in mixed colors, then the player is awarded the bonus amount in the display 1206 for the present column. If the player receives the symbols spelling BONUS in the same colors (i.e. all red, white or blue) then the player is awarded the bonus amount in the display 1206 for all columns 1202.

In one or more embodiments, a player is declared a winner if the player receives the same number on each of the reels 1241 (i.e. all ones, twos), and that number has not already been played. In a preferred embodiment, when the player receives the same number on each of the reels 1241, then the player is awarded the payout for 5 of a Kind as well as the bonus amount.

If the player is a winner, then in step 1329, the total of any winnings is displayed in the total 1205 portion of the column being played. In the preferred embodiment, the column being played is the left-most column 1202 which has yet to be played. The totals of all column 1202 totals are displayed in the total score area 1239.

As an example, if a player receives BONUS spelled in other than symbols of a single color, then the player receives the bonus amount 1206 for that column. That amount is then placed into the total portion 1205 of that column and then indicated in the total score area 1239 along with any other previous total amounts. If a player receives BONUS spelled in a single color, then the player receives the bonus amount 1206 for each and every column. In such event, the totals 1205 for each column 1202 are updated to reflect this winning, as is the player's total score. If a player receives a 5 of a Kind of a new target number, then the player is awarded the payout for a 5 of a Kind and the bonus amount, and the first open column 1202 is highlighted and the target number displayed thereabove.

In a step 1330, once the player has been declared a winner, it is determined if the player received a win by a 5 of a Kind or receiving the BONUS symbols. If the player received a 5 of a Kind win, then in step 1332, it is determined if the player wishes to cash out (as via a step 1348 as described below).

If the player won by receiving the BONUS symbols, then the player is entitled to respin again in an attempt to obtain a combination of target numbers, as in step 1224. Of course, if the player again receives a win on the first spin, the process repeats. If the player received the same number on each of the reels, i.e. a 5 of a Kind, then the play for that particular target number is completed and the player moves to the next round. In one or more embodiments, the player may be required to place another bet in order to spin again after having received a win by hitting the BONUS win.

If in step 1326 it is determined that the player did not place a maximum bet, then in step 1334 it is determined if the player received a 5 of a Kind of a new target number. If so, then in step 1336, the player is awarded the payout for that combination, and the award is displayed in the appropriate column. It is next determined if the player wishes to cash out in step 1348.

If in steps 1326 and 1334 it is determined that the player did not receive a BONUS win or a 5 of a Kind, then in step 1338, the player is permitted to "hold" any of the reels 1241 which display a number. When the player holds a particular number, that that number becomes the target number. For example, referring to FIG. 12, the player may wish to hold the six displayed in the first column 1202.

In a step 1240, when the player makes a hold selection, the target number is displayed in the first available column 1202 of the scorecard 1201. In one embodiment, the first available column comprises the left-most column 1202 which has not been utilized during the game. Preferably, the target number is illustrated by illustrating the target number on the dice at the top of the column. In the example given above, a dice displaying a six would be displayed in the left-most column 1002.

In one or more embodiments, a player is not permitted to select as a target number a number which has already been played in a particular game. If the player attempts to do so, a message may be displayed in the text message box 1245 to the effect that the selected number has already been played and the player must either select a new target number or spin again. Another spin may be required where the first spin results in only numbers which have already been utilized. In addition, if the player selects more than one number (such as a simulated dice 1241 displaying a five and another displaying a two) the player be instructed that the action is not permitted and the player must select only one target number. Also, a player is not permitted to hold any of the non-numeric symbols, such as B, O, N, U or S.

Preferably, when a number is selected, the particular column 1202 is highlighted, such as in brightness or a different color, to aid the user in identifying which information is pertinent to the present round of the game. In addition, once a particular target number is selected, the payouts are highlighted in the central payout portion 1204 of the scorecard 1201.

In one or more embodiments, the particular payout is dependent upon the player's wager, with the payout increasing with an increasing wager. These payouts may be similar to those described and illustrated above.

In one embodiment, payouts for combinations of target numbers which are eliminated may be removed from the scorecard 1201. For example, the payout for a 3 of a Kind may be removed from the column 1202 being played when the player has already received at least a 4 of a Kind. In addition, the payout which the player has already received upon the first spin for that target number may be highlighted to bring to the attention of the player that he or she has already won. This highlighting may be by displaying the payout in a distinguishing color or brightness or other means available. The word "paid" may be indicated in the particular area of the scorecard 1201 as well.

In accordance with the present invention, in a step 1342, after holding one or more of the reels 1041, or after an indication that no reels 1241 can be held, then the player presses the spin button 1249 again. All of the reels 1241 which were not held spin and then stop, again displaying a number.

In a step 1344, it is determined if the player has received any predetermined winning combinations. If the player did not hold any of the reels 1241, it is possible that on the second spin the player received the symbols spelling BONUS. Preferably, the player is awarded a win as described above for spelling BONUS, if the player has placed the maximum bet. In any event, if the player spells BONUS, that player is entitled to an extra spin in order to permit the player to receive the maximum number of the target numbers.

It is also determined if the player has received a combination of the target number which qualifies as a win. In the embodiment illustrated, the player is a winner if he or she receives at least three of the target number, such as 3 of a Kind, 4 of a Kind or 5 of a Kind of the target number, or if the player receives a full house (i.e. 3 of a Kind of the target number plus a pair of another number).

A win total is displayed in the win total area 1205 of the particular column. This win total may be 0, in the event the player did not receive a winning combination (for example, a player may elect to hold two dice showing the target number after the first spin and not receive any additional dice showing the target number after the second spin, thus not receiving a minimum three of the target number for an award). The total payout to the player may be updated in the winner paid display area 1271.

In a step 1346, the win totals from all win total areas 1205 are displayed, then summed and displayed as a total score in the total score area 1239. Preferably, a qualifying score for a jackpot bonus is displayed in the qualifying score area 1240, again which the player may compare their score.

In a step 1348 it is determined if the player wishes to cash out. This is indicated by a player pressing the collect button 1263. In such event, any accumulated winnings and credits are paid to the player. In that event, the game ends.

If the player wishes to continue the game, it is determined in a step 1332 if all of the columns 1202 of the scorecard 1201 are filled (i.e. all of the target numbers have been played). If so, then the player has completed the game. In a step 1350, the player's total score is then compared to the qualifying score to determine if the player qualifies for participation in the jackpot. If the player qualifies, then in a step 1248, the player is provided with a voucher or the like, in similar manner to that described above. This voucher may be dispensed by the jackpot ticket dispenser 1276.

If all of the columns 1202 of the scorecard 1201 are not filled, the player may, save the game in step 1352, or repeating again to step 1322, place a bet or wager. The player may be provided with an indication in the text message box 1245 after a given round that they may place abet to continue with the game or save the game. To save the game, the player activates the save-restore button 1278 which initiates the process in step 1354 allowing the player to leave the game and resume the same game at a later time as described in more detail below.

In a preferred embodiment, after a particular target number has been played in a round, that target number is removed from each reel 1241. Preferably, the space for the removed target number is made blank. In other embodiments, as described above, the symbol may be replaced.

Further, upon the beginning of the next round, the column 1202 for the last target number is darkened or the like so that the player's attention is directed to the now active column 1202. It is preferred, however, that any winning amounts to the player still be displayed in the prior columns 1202 for identification by the player. In addition, it is preferred that the bonus amount for each played column be removed so as to not confuse the player. In such event, the bonus amount for each previously played column is placed in a bonus pool for award to the player in the event the player receives a combination of the letters BONUS in all of the same color.

The game then continues as described above. It will be appreciated that after a first target number has been played, a spin of the reels 1241 may result in a display of all of the remaining numbers and/or the symbols used to replace the already played target number. As the number of played numbers increases, the probability of receiving a target number decreases. For this reason, as detailed above, the payout for receiving a winning combination of each target number increases as the game progresses.

It will be appreciated that the particular symbols which are utilized in the game of Z Jackpot Dice may vary. For example, the non-numeric symbols need not comprise the letters B, O, N, U and S, and do not need to comprise one of each in three different colors. For example, the non-numeric symbols might comprise pictures of fruit or other items. Differing combinations of the non-numeric symbols may be achieved through color, size or other designation. In addition, a greater or lesser number of non-numeric symbols may be provided with each reel. For example, there may be only two, or as many as four or more of each of the letters, each in different colors.

It will also be appreciated that in one or more embodiments, player may be permitted to hold one of the non-numeric symbols, i.e. B, O, N, U, and/or S, in an attempt to gain a winning combination of such symbols on a second spin or play.

While a specific order of events has been described for the play of the games, the order of events and activities may be varied from that above.

Utilizing a local area computer network 301 and a wide area computer network 401, multiple players may play games against one another instead of "against the house." Utilizing a local area computer network 301, each participating player deposits money into an individual computer-controlled slot machine 101 for each spin. The player who achieves the highest game score of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

As described above, in any of the games of the invention a player may attempt to obtain a high total score for qualifying for a jackpot. Those of skill in the art will appreciate the enticement of such a jackpot award system to a player because a player need only achieve a sufficiently high score to be included in the jackpot award. It should be noted one or more embodiments may vary the size, prizes, qualifying minimum, period, and player tracking of a jackpot as well as participation in a jackpot.

It will be appreciated that the predetermined winning combinations and their payouts may vary from those described and illustrated herein. In addition, the total number of reels or simulated dice may be varied. Those of skill in the art will appreciate that as the total number of available combinations changes, the payouts may need to be changed in order to both entice a player into playing and yet prevent the house from risking loss.

In the above-described games, a player may preferably save a game in progress by pressing the touch-sensitive save-restore game button 559, 1278 or pause game button 1059. The computer program 601 then utilizes the machine-readable medium reading and writing device 129 to write the present scores and game states to a card, voucher (such as a printed ticket or token) or other medium which the player can take with them. The player may later resume the saved game by inserting such card or voucher of machine-readable medium into the reading and writing device 129 of any computer-controlled slot machine 101. The saved game information is then read from the card or voucher to initialize the conditions and states of the computer-controlled slot machine 101. In various embodiments, a magnetic or optical or semiconductor medium may be used as desired to store and transfer scores and game states and other pertinent data on such card or voucher produced by the video slot machine 101.

In one or more embodiments, when the player elects to pause or save a game in progress, game state information is generated. This information may be stored to the medium which is provided to the player, or may be stored remotely, such as at a central server associated with the games when they are linked. In such event, a code or other information need only be stored or associated with the medium provided to the player. When the code is read or inputted into a game at a later time, the code may cause the game to access the game state information stored separately from the medium. In this manner, a player may be permitted to cease playing a game at a first time and pickup that same game at a later time, and even at a different gaming station offering the game. It will be appreciated that such a similar function may be applied any of the games herein or even games other than those described herein, such as those games now known or later invented. Further, it should be noted that the games may be arranged so that a player may engage the pause function, as well as the cash-out and other features of the games, at times other than those specifically described above. For example, a player may be permitted to pause a game at any point, and not specifically only after the completion of a given round of play.

It will be appreciated that games in accordance with the invention need not be the same as those described above. In one or more embodiments, the game may comprise simply implementation of the basic concept. In such an arrangement, the game may includes the steps of a player placing a wager, the providing of a set of symbols, displaying a number of the symbols from the set of symbols, the player having the opportunity to hold none, one or more of the symbols, displaying replacements symbols to those which are not held, comparing the final set of displayed symbols to predetermined winning combinations of symbols to determine if the player is entitled to a winning payout, providing the player an option to save the game, and then removing from the set of symbols at least one of the symbols, thereby reducing the possible number of combinations achievable thereafter by the player. Preferably, as the number of combinations which the player may achieve are reduced, the payout for achieving a winning combination increases.

As in the embodiments described above, the symbols are or include the faces of dice. As target numbers are played, those number or indicia are removed from play. Of course, a game may utilize other indicia. As rounds, hands or the like of play are completed, the symbols may be removed randomly or in accordance with winnings combinations received by the player. Also, it should be noted other features such as jackpots and bonuses may be omitted or be applied in various combinations to any of the games herein or other embodiments.

In particular, a number of other alternate embodiments or alternate arrangements to the games other than as described above are contemplated. First, it will be appreciated that one or more of the features of any one game described above may be applied to another.

One or more embodiments of the invention, may as described above with respect to the game of Check, not include the step of removing one or more of the symbols as game progresses. Instead, the player may continue play, attempting to achieve winning combinations, jackpots, bonuses (or other of the features/elements) using the same set of symbols as play progresses.

In an alternative embodiment, the games may be played over the Internet or other wired/wireless communications network/system.

As used herein, the term "computer-controlled slot machine" denotes a computer controlled machine which facilitates wagering, which generally requires the input of money in order to be operated, and which outputs money in response to the achievement of winning wagering results. It will be appreciated that one or more aspects of the machine, including the interface or what is referred to herein as the touch sensitive display may be electrical, mechanical and/or electro-mechanical in nature. For example, while the buttons may comprise touch-sensitive areas of a display, they may comprise electro-mechanical buttons which are activated by mechanical movement (such as depression) by a player. In addition, the simulated dice may, instead of comprising solely computer generated images, actually comprise dice or dice faces mounted on a rotating reel and arranged to stop in controlled positions. The simulated dice or other symbols may be provided in a variety of other manners, such as by laser light generation. The dice or other symbols are referred to in certain instances as "simulated," but could actually comprise faces of actual physical dice. The displays and display areas may comprise CRT type displays, LCD or LED displays or any other means for displaying information now known or later developed.

It will be appreciated that various features of the present invention may be applied to existing games or games later developed. For example, the feature of permitting a player to "pause" or save a game and then continue the game at one or one of several gaming machines may be applied to present or future games. For example, the pause feature may be applied to video poker games or the like. Likewise, the feature of having bonuses associated with more than one event and/or cumulative bonuses may be applied to present or future games.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of operating a gaming system, said method comprising:

(a) enabling a player to place a wager on a play of a first game at a first gaming machine at a first location;

(b) if a second game triggering event occurs in association with the play of the first game at the first gaming machine, enabling the player to play a second game at the first gaming machine, the play of the second game being associated with a plurality of subsequent plays of the first game;

(c) enabling the player to end the play of the second game prior to a final award being provided to the player for the play of the second game;

(d) at a first point in the play of the second game and prior to said final award being provided to the player, enabling the player to make a game state input at said first gaming machine, said first point corresponding to any point in the play of the second game ranging from any point subsequent to an initiation of the play of the second game to any point prior to said final award being provided to the player for the play of the second game;

(e) in response to the player making the game state input:

(i) generating game state information corresponding to said first point in the play of the second game at said first gaming machine; and (ii) storing said generated game state information on a machine-readable medium; and (f) thereafter, at a second, separate gaming machine:

(i) reading said game state information from said machine-readable medium;

(ii) utilizing said game state information to enable the player to resume the play of the second game from said first point in the play of the second game, wherein the play of the second game is resumed from said first point in the play of the second game regardless of any occurrence of any event associated with the play of the second game and regardless of any non-occurrence of any event associated with the play of the second game;

(iii) providing the player said final award for play of the second game; and (iv) if an amount of said final award provided to the player for the play of the second game is at least a designated threshold amount, enabling the player to play a third game.

2. The method in accordance with claim 1 wherein said game state information comprises information comprising the number of credits belonging to said player.

3. The method in accordance with claim 1 wherein said medium is a removable medium issued to said player.

4. The method in accordance with claim 1 wherein said medium comprises a player card.

5. The method in accordance with claim 1 wherein said machine-readable medium is a printed ticket.

6. A method of operating a gaming system, said method comprising:

(a) enabling a player to place a wager on a play of a first game at a first gaming machine;

(b) if a second game triggering event occurs in association with the play of the first game at the first gaming machine, enabling the player to play a second game at the first gaming machine, the play of the second game being associated with a plurality of subsequent plays of the first game;

(c) enabling the player to end the play of the second game prior to a final award being provided to the player for the play of the second game;

(d) at a first point in the play of the second game and prior to said final award being provided to the player, enabling the player to make a game state input to pause the play of the second game at said first gaming machine, said first point corresponding to any point in the play of the second game ranging from any point subsequent to an initiation of the play of the second game to any point prior to said final award being provided to the player for the second play of the game;

(e) in response to the player making the game state input:

(i) generating game state information corresponding to said first point in the play of the second game at said first gaming machine;

(ii) storing said generated game state information on a storage medium; and (iii) associating identifying information with said generated game state information; and (f) thereafter, at a second, separate gaming machine:

(i) utilizing said identifying information to identify said generated game state information;

(ii) enabling the player to resume the play of the second game from said first point in said play of the second game based on said generated game state information, wherein the play of the second game is resumed from said first point in the play of the second game regardless of any occurrence of any event associated with the play of the second game and regardless of any non-occurrence of any event associated with the play of the second game;

(iii) providing the player said final award for the play of the second game; and (iv) if an amount of said final award provided to the player for the play of the second game is at least a designated threshold amount, enabling the player to play a third game.

7. The method in accordance with claim 6 wherein said generated game state information comprises information comprising a quantity of credits associated with the player.

8. The method in accordance with claim 6 wherein said identifying information is stored on a removable medium remote from said storage medium.

9. The method in accordance with claim 6 wherein said identifying information comprises information identifying said player.

10. The method in accordance with claim 6 wherein said storage medium is a printed ticket.

11. A method of operating a gaming system, said method comprising:

(a) enabling a player to place a wager on a play of a first game at a first gaming machine;

(b) if a second game triggering event occurs in association with the play of the first game at the first gaming machine, enabling the player to play a second game at the first gaming machine, the play of the second game being associated with a plurality of subsequent plays of the first game;

(c) enabling the player to end the play of the second game prior to a final award being provided to the player for the play of the second game;

(d) at a first point in the play of the second game and prior to said final award being provided to the player, enabling the player to make a game state input to pause the play of the second game at said first gaming machine, said first point corresponding to any point in the play of the second game ranging from any point subsequent to an initiation of the play of the second game to any point prior to said final award being provided to the player for the play of the second game;

(e) in response to the player making the game state input:

(i) generating game state information corresponding to said first point in the play of the second game at said first gaming machine;

(ii) storing said game state information at a remote computing device; and (iii) storing information identifying said remotely stored game state information on a machine-readable medium; and (f) thereafter, at a second, separate gaming machine:

(i) reading said identifying information from said machine-readable medium;

(ii) using said identifying information to obtain said remotely stored game state information;

(iii) utilizing said obtained game state information to enable the player to resume the play of the second game from said first point in the play of the second game, wherein the play of the second game is resumed from said first point in the play of the second game regardless of any occurrence of any event associated with the play of the second game and regardless of any non-occurrence of any event associated with the play of the second game;

(iv) providing the player said final award which results from the play of the second game; and (v) if an amount of said final award provided to the player for the play of the second game is at least a designated threshold amount, enabling the player to play a third game.

12. The method in accordance with claim 11 wherein said game state information comprises information regarding a quantity of credits associated with the player.

13. The method in accordance with claim 11 wherein said game state information comprises information regarding information displayed on a display to said player.

14. The method in accordance with claim 11 wherein said machine-readable medium comprises a player tracking card.

15. The method in accordance with claim 11 wherein said machine-readable medium comprises a printed ticket.

* * * * *